US008122654B2

(12) United States Patent
Sprague

(10) Patent No.: US 8,122,654 B2
(45) Date of Patent: Feb. 28, 2012

(54) TAPER LOCK SYSTEM

(75) Inventor: Gary Sprague, Los Angeles, CA (US)

(73) Assignee: C.R. Laurence Company, Inc., Los Angeles, CA (US)

( * ) Notice: Subject to any disclaimer, the term of this patent is extended or adjusted under 35 U.S.C. 154(b) by 802 days.

(21) Appl. No.: 12/119,420

(22) Filed: May 12, 2008

(65) Prior Publication Data

US 2009/0230372 A1 Sep. 17, 2009

Related U.S. Application Data

(60) Provisional application No. 61/036,850, filed on Mar. 14, 2008.

(51) Int. Cl.
*E06B 3/964* (2006.01)
*E06B 3/988* (2006.01)

(52) U.S. Cl. ..... 52/204.62; 52/204.64; 52/204.69; 52/204.7

(58) Field of Classification Search ..... 52/204.62, 52/204.64, 204.69, 204.7; 256/24; 29/239, 29/428

See application file for complete search history.

(56) References Cited

U.S. PATENT DOCUMENTS 1,553,785 A 9/1925 Ley (Continued)

FOREIGN PATENT DOCUMENTS

DE 1237287 A 3/1967

(Continued)

OTHER PUBLICATIONS

Blumcraft of Pittsburgh M-98 Railing Catalogue, 1997, pp. 7 and 9-13.

(Continued)

*Primary Examiner* — Mark Wendell

(74) *Attorney, Agent, or Firm* — Mitchell P. Brook; Luce, Forward, Hamilton & Scripps LLP

(57) ABSTRACT

A glass locking system of locking a glass panel within a base shoe having side walls, comprising a first tapered plate having a first end and a second end. The first plate is tapered such that the first end is thinner than the second end. A second tapered plate has a first end and a second end, the second plate being tapered such that the first end is thinner than the second end. The first and second plate are insertable between a side wall of the base shoe and a glass panel in overlapping relation. Moving the second tapered plate laterally towards the first plate serves to generate a compressive force on the glass panel, and moving the plates laterally apart serves to reduce the compressive force on the panel.

19 Claims, 21 Drawing Sheets

U.S. PATENT DOCUMENTS

| | | | | | |
|---|---|---|---|---|---|
| 2,039,879 | A | | 5/1936 | Brown et al. | |
| 2,169,713 | A | | 8/1939 | Stroud | |
| 2,589,517 | A | | 3/1952 | Stelzer | |
| 3,190,408 | A | | 6/1965 | Petterson | |
| 3,190,409 | A | | 6/1965 | Petterson | |
| 3,404,501 | A | * | 10/1968 | Von Wedel | 52/204.64 |
| 3,836,118 | A | * | 9/1974 | Meyer | 254/104 |
| RE28,643 | E | | 12/1975 | Blum | |
| 4,067,548 | A | | 1/1978 | Murphy | |
| 4,103,874 | A | | 8/1978 | Horgan, Jr. | |
| 4,220,420 | A | | 9/1980 | Aston et al. | |
| 4,325,488 | A | | 4/1982 | Ketner | |
| 4,364,209 | A | | 12/1982 | Gebhard | |
| 4,423,582 | A | | 1/1984 | Yates | |
| 4,520,611 | A | * | 6/1985 | Shingu et al. | 52/786.11 |
| 4,569,383 | A | | 2/1986 | Wentzel | |
| 4,920,717 | A | | 5/1990 | Hooper, Jr. | |
| 5,205,099 | A | | 4/1993 | Grunhage et al. | |
| 5,339,583 | A | | 8/1994 | Hrdlicka et al. | |
| 5,444,958 | A | * | 8/1995 | Lu | 52/775 |
| 6,266,940 | B1 | * | 7/2001 | Reichert | 52/786.13 |
| 6,339,909 | B1 | * | 1/2002 | Brunnhofer et al. | 52/786.13 |
| 6,419,209 | B1 | | 7/2002 | Shepherd | |
| 6,517,056 | B2 | | 2/2003 | Shepherd | |
| 6,912,818 | B2 | * | 7/2005 | Sprague | 52/208 |
| 7,036,799 | B2 | | 5/2006 | Shepherd | |

FOREIGN PATENT DOCUMENTS

| | | | |
|---|---|---|---|
| DE | 3236226 | A1 | 4/1984 |
| GB | 2235008 | A | 2/1991 |
| GB | 2251261 | A | 7/1992 |
| GB | 2254360 | A | 7/1992 |
| JP | 2000336936 | A | 12/2000 |
| WO | WO03/033850 | A1 | 4/2003 |

OTHER PUBLICATIONS

C.R. Laurence 63 ARCH Architectural Hardware, 2006, pp. cover, I, H630-H649, H768 and H832-H841.

* cited by examiner

TAPER LOCK SYSTEM

CROSS-REFERENCE TO RELATED APPLICATIONS

This application claims priority to U.S. Provisional Patent Application Ser. No. 61/036,850, filed Mar. 14, 2008, the disclosure of which is hereby incorporated by reference in its entirety.

FIELD OF THE INVENTION

The present invention relates to panel installation and removal systems.

BACKGROUND OF THE INVENTION

Glass panel railing systems are used in commercial spaces and homes, and frequently are desired due to an attractive appearance derived from transparent or translucent properties. They typically are used as guard rails at the edge of a physical drop, for traffic control or for partitioning of spaces. Known glass panel systems include vertical panels and a base shoe assembly. The bottom edges of the panel are installed in the base shoe while the top edges may support a top rail or handrail. However, installation of the bottom edges of glass panels into a base shoe assembly can be difficult, expensive and time-consuming.

Currently used flat panel installation systems and methodology suffer from a number of disadvantages. Some systems require cement to hold the panels in place in a base shoe. In such methods, the installer may pour quick-setting cement into a groove in the base shoe. In this installation technique it can be difficult to completely seal the groove using cement, or to ensure the cement maintains a smooth and attractive appearance. Required adjustments are difficult to make, and cement spillage or leakage is a problem.

Another known installation system employs a wedge driven vertically into a base shoe, typically using a hammer and chisel. However, it is difficult to install the panel with sufficient accuracy because such systems lack a precise way to measure the clamping force on the panel, and the base shoe's mounting surface can be damaged from the high impact. The base shoe's decorative cladding is prone to damage during removal of the wedge for adjustment or glass replacement, and errant use of the hammer could damage the glass panel. The wedge also may extend above the base shoe creating a visual appearance flaw, and it may not fully accommodate requisite industry standard tolerances. Thus, there is a need for a panel installation system that is easy to use, will not damage the base shoe cladding and sufficiently clamps the glass panel, all within desired installation tolerance levels.

Moreover, in existing systems installation and extraction of the panel typically requires two different tools. The extraction tool is generally cumbersome, inconvenient and difficult to use, in part because of difficulty in access to the wedged locations. It also is known that the installation tool may fail under stresses resulting from the extraction operation, and there is a risk of damage to or breakage of the glass panel, and damage to the base shoe cladding. Thus, there is a need for a an extraction tool that is less cumbersome yet sturdy, easier to operate and optionally be used for both installation and extraction of a glass panel.

There also exists a need for an installation system for glass panel railing systems that eliminates the need for pouring cement during the installation process, and which does not require exertion of large vertical forces on the base shoe mounting surfaces during the installation process such as result from the vertical wedge system. There also exists a need for a panel installation system having a single tool that can be used both for insertion and extraction and allows the installer to work on the pedestrian or "person" side of the guard railing system. In addition, there is a need for a relatively small, sturdy installation/extraction tool that is convenient and easy to use, and enhances the ease of exerting consistent and desired forces to properly clamp the glass panel.

SUMMARY OF THE INVENTION

The present invention, in its many embodiments, alleviates to a great extent the disadvantages of known flat panel installation systems by providing a system of installation of a panel into a base shoe using lateral clamping forces optionally applied using a single tool for installation and extraction. The glass locking system functions without the need to apply vertical forces on the base shoe, thereby reducing the chances of damaging the base shoe's mounting surfaces, and scratching of the glass from hammering or removal. Embodiments of the present invention are well-suited for panel railing systems having panels and flat glass panels in particular. However, it should be noted that the principles and embodiments described herein are applicable to panels made from a variety of materials such as metal or plastic.

Embodiments of the panel installation system of the present invention include a spacer having a long leg and a short leg and two plates, one plate being movable by operating the installation tool. A first plate has a first end and a second end, and the plate is tapered such that the first end is thinner than the second end. A second plate also has a first end and a second end and is tapered such that the first end is thinner than the second end. In some embodiments, one or more of the first plate and the second plate has a projection tab. The projection tab may extend from the second end the plate at an intermediate point or may be an upward projection from the top of the plate.

A preferred embodiment includes an installation tool that assists the installer in applying the appropriate amount of torque on the mounting components to insert and mount the panel properly. The installation tool comprises a chassis, at least one fixed blade having a first end and a second end and at least one movable blade having a first end and a second end. In one embodiment, the installation tool chassis has soft or non-metallic surfaces on the top and bottom to reduce or prevent potential damage from exposure of the panel and base shoe cladding to hard, rough or metal components of the installation tool. There is also a top linear bearing adjacent the non-metallic top surface and a bottom linear bearing adjacent the non-metallic bottom surface in another aspect of the invention. The installation tool also may include at least one handle and, preferably, a handle at each end of the chassis to accommodate both right-handed and left-handed users.

A blade motion assembly also is provided in the installation tool, which is operated via a torque wrench. The assembly in one embodiment includes a rack and a pinion shaft having a top surface and a bottom surface engagable by the torque wrench. One or more wave springs may be provided on the pinion shaft. The blade motion assembly further comprises a first shoulder bushing at or near the top surface of the pinion shaft and a second shoulder bushing at or near the bottom surface of the pinion shaft. The first end of the fixed blade is attached to the installation tool chassis, and the first end of the movable blade is attached to the rack of the blade motion assembly. The second end of the fixed blade and the movable blade each has a groove for purposes of mating with the projection tabs of the plates. The engagement blades may have one or more bumpers on their surface to protect the panel from scratches and may also include a knurled surface. An array of gear teeth wraps around the pinion shaft and rotatably mates with a row of gear teeth on the rack. Rotating the torque wrench causes the pinion shaft to rotate, and the pinion shaft rotation moves the rack, thereby moving the movable blade. In some embodiments, the precision tool has a torque range indicator, which provides a sensory cue when the rotation of the torque wrench has applied the compressive force sufficient to hold the panel in the base shoe.

The fixed blade and the movable blade each have a first end and a second end with the first end attached to the chassis of the installation tool. In a preferred embodiment, there is a groove at the second end of each blade, and the second end of the fixed blade mates with the projection tab of the first plate while the second end of the movable blade mates with the projection tab of the second plate. The blade and plate system provides the advantage of clamping the flat panel without exerting a vertical force on the base shoe. The blades function both to push the plates to the bottom of the base shoe and to slide the second plate toward the first plate. Rotating the torque wrench of the installation tool in one direction operates the blade motion assembly to move the movable blade, thereby sliding the second plate toward the first plate such that the first and second plates are overlapping and fixed together to narrow the space in the base shoe and hold the panel in place. Rotating the torque wrench in the opposite direction operates the blade motion assembly to move the movable blade, thereby sliding the second plate the other way away from the first plate so the first and second plates are separated to widen the space in the base shoe and release the panel.

These and other features and advantages of the present invention will be appreciated from review of the following detailed description of the invention.

BRIEF DESCRIPTION OF THE DRAWINGS

The foregoing and other objects of the invention will be apparent upon consideration of the following detailed description, taken in conjunction with the accompanying drawings, in which.

DETAILED DESCRIPTION

In the following paragraphs, embodiments of the present invention will be described in detail by way of example with reference to the accompanying drawings. Throughout this description, the embodiments and examples shown should be considered as exemplars, rather than as limitations on the present invention. As used herein, the "present invention" refers to any one of the embodiments of the invention described herein, and any equivalents. Furthermore, reference to various aspects of the invention throughout this document does not mean that all claimed embodiments or methods must include the referenced aspects.

Figure 1:
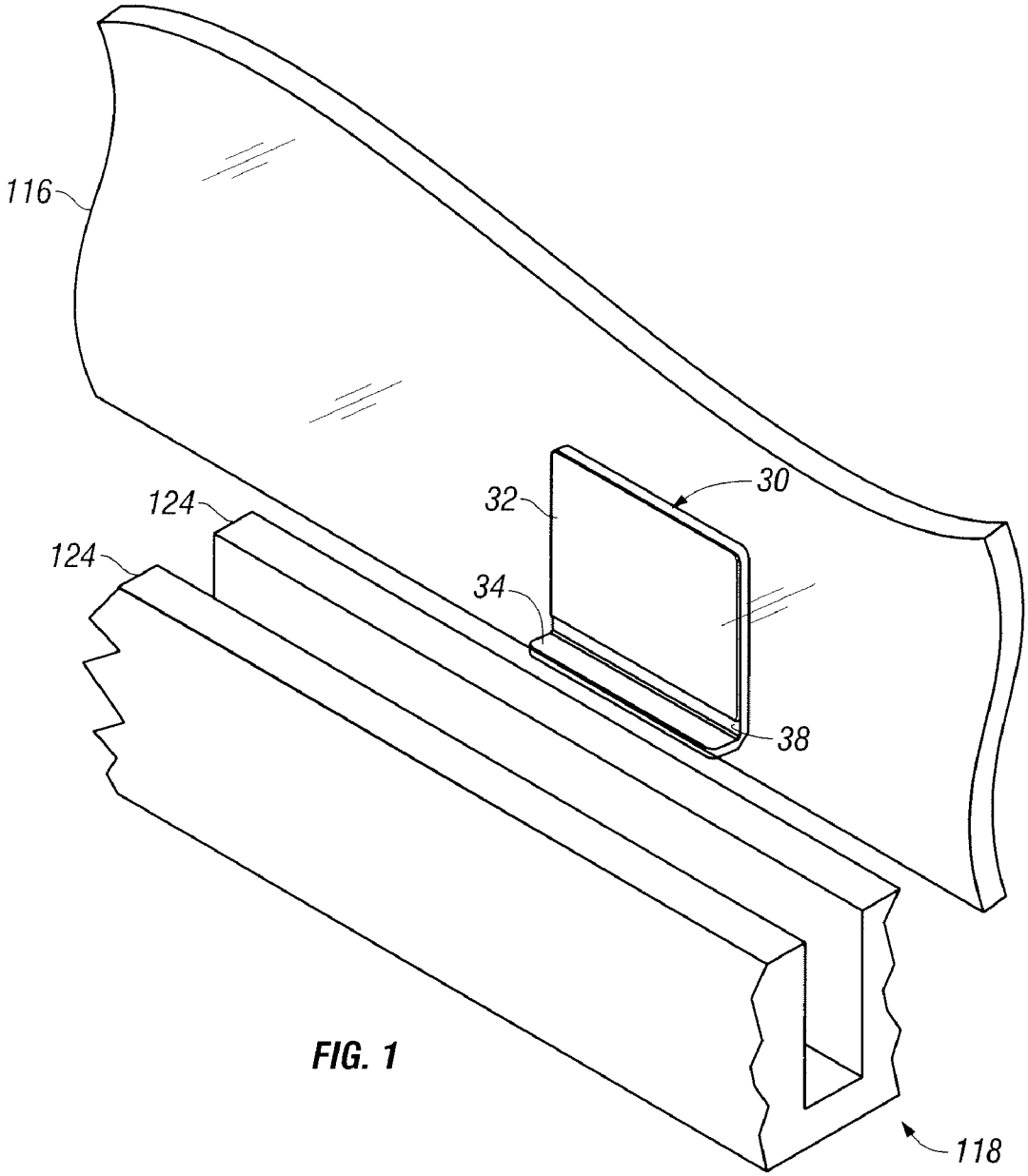
FIG. 1 is a perspective view of an embodiment of a spacer in accordance with the present invention.
Figure 2:
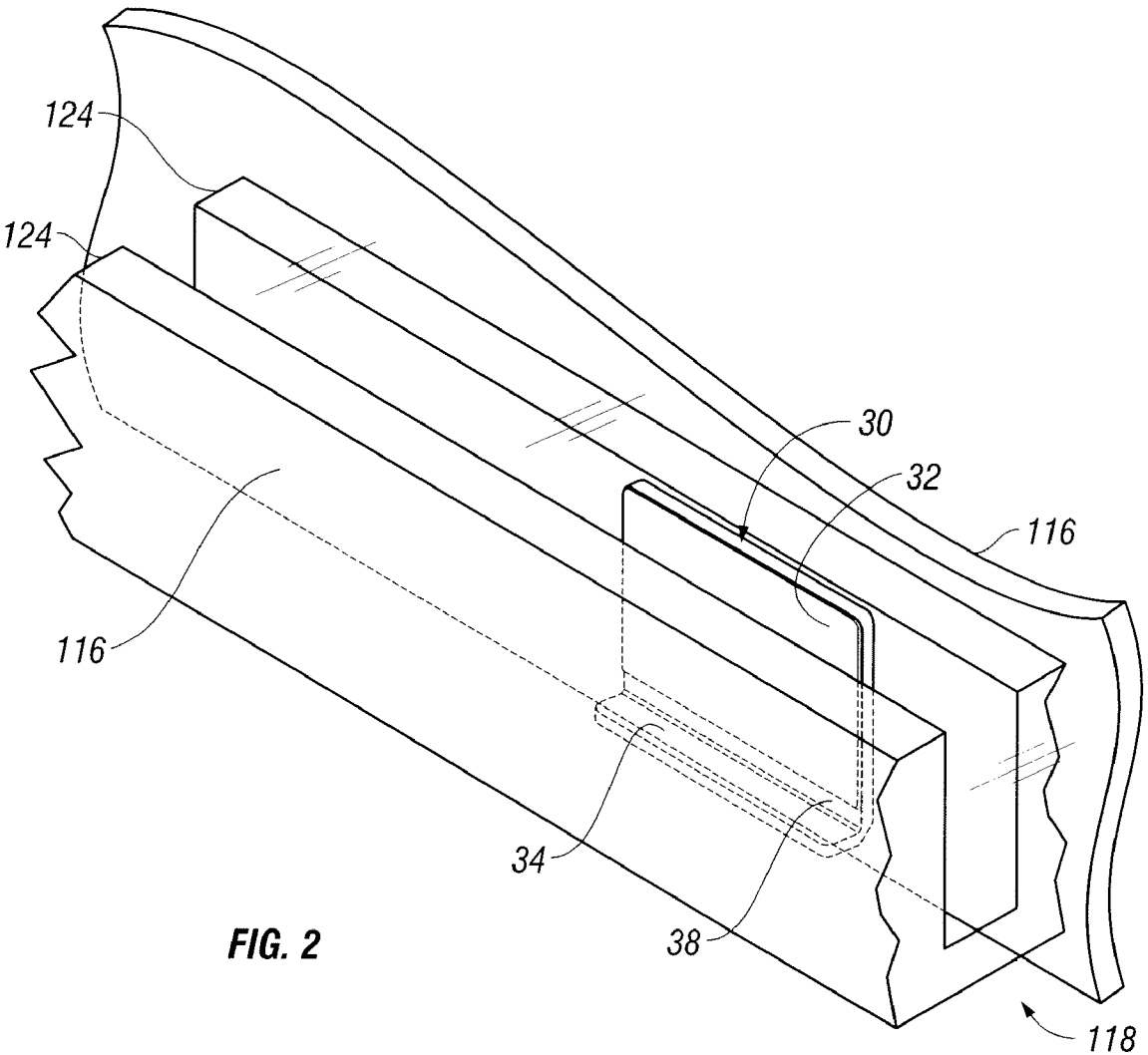
FIG. 2 is a perspective view of an embodiment of a spacer in accordance with the present invention shown with a panel and a base shoe.
Figure 3:
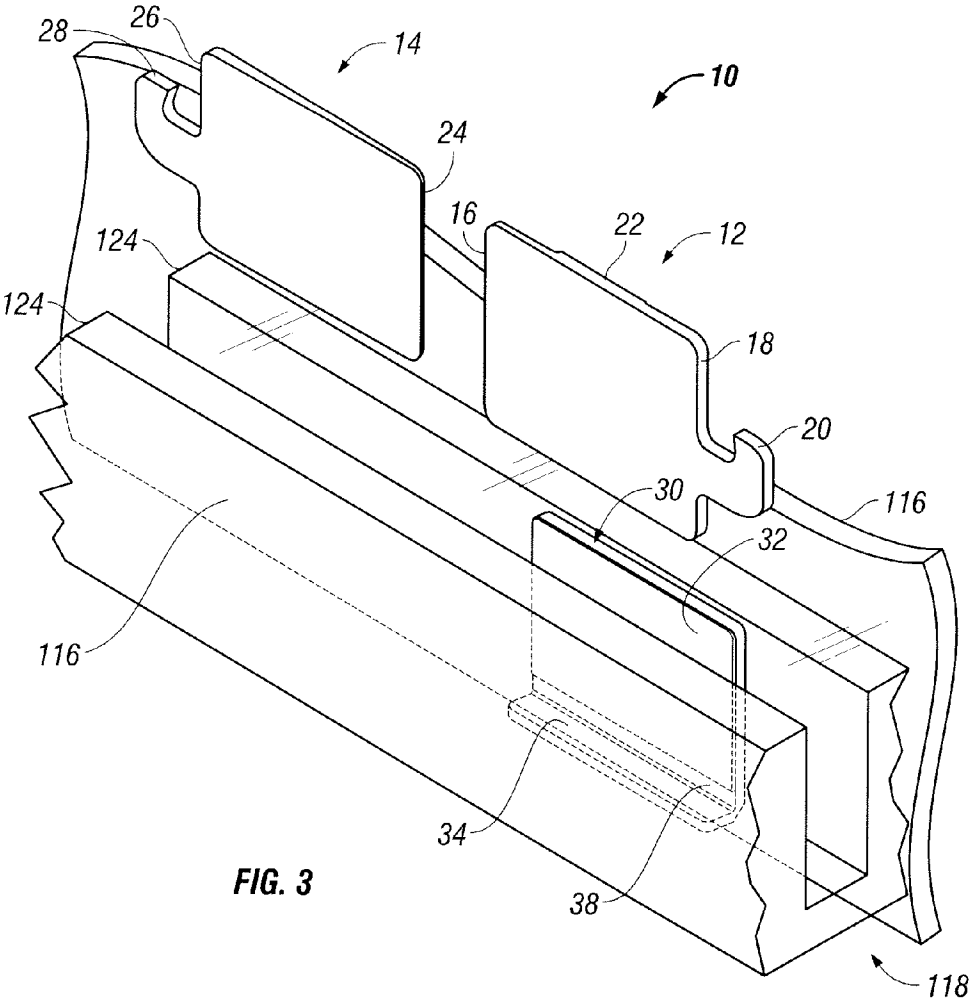
FIG. 3 is a perspective view of an embodiment of the installation system in accordance with the present invention shown with a panel and a base shoe.

Referring to FIGS. 1-7, an embodiment of a glass locking system is shown. Glass locking system 10 comprises first plate 12 and second plate 14. The two plates have similar and complementary tapered structure. First plate 12 has a first end 16 and a second end 18 and is tapered such that the plate is thinner at the first end than at the second end. First plate 12 further has a projection tab 20. As shown in FIG. 1, projection tab 20 extends from the second end of the plate at an intermediate point at second end 18. In a preferred embodiment there is a gib projection 22 on the top of first plate 12 which engages second plate 14. Second plate 14 comprises first end 24 and second end 26. The second plate also is tapered so the first end 24 is thinner than the second end 26 and has a projection tab 28 extending from the second end at an intermediate point. As will be described in more detail herein, projection tab 28 receives the outward or separating force when the two plates are separated during extraction. In an embodiment shown in FIG. 7, the projection tab may be an upward projection 114 from the top of the plate. Projection tabs 20 and 28 preferably have hook-shaped profiles. Both plates have a flat side and a tapered side, and as second plate 14 moves toward first plate 12 and the two plates fixedly engage each other, the tapered sides contact each other. The plates are insertable between a side wall 124 of a base shoe 118 and a glass panel 116 in overlapping relation with the flat side of second plate 14 contacting the flat panel 116 being installed, and the flat side of first plate 12 contacting the front wall of the base shoe 118.

Below the plates there is provided a spacer 30 to space the panel 116 from the base shoe 118. Spacer 30 also serves to support the panel 116 and protect the bottom of the panel as it is lowered into base shoe 118. Multiple spacers may be inserted in the base shoe 118 spaced apart approximately 14 inches from center to center, the number of spacers depending on the length of the panel to be installed. The spacer 30 may have a long leg 32 and a short leg 34 and preferably forms a substantially L-shaped cross section. However, other structures may be used, such as a U-shape or any other configuration that provides support for a panel during installation. A strip of double-sided tape 36 may be provided on the top surface of short leg 34 to facilitate attachment and secure the panel 116 to the spacer 30. With the panel 116 disposed in the "L" of spacer 30, only the person side surface is exposed during installation; the lower back side and the bottom of the panel 116 are protected by the long leg 32 and short leg 34, respectively, of the spacer.

Panel 116 is further protected by an additional structural feature of spacer 30, namely recess 38 located on the spacer at the transition of long leg 32 and short leg 34. Recess 38 protects the bottom edge of the panel 116 from forces applied during the installation process that may exert stress on the panel. Recess 38 also serves to protect the glass panel's fragile edges during moments of lateral load, load resulting from wind, seismic movement, equipment and human applied force. The structure of spacer 30 also may include vertical ribs on the back side of long leg 32 controlling the maximum part thickness, thereby producing a flat part of consistent thickness tolerance. The spacer 30 preferably is manufactured by plastic injection molding rather than by extrusion, which results in a stronger component having better tolerances.

Embodiments of the panel installation system as described above may be used in conjunction with a number of different mechanisms as long as the employed means can slide the second plate 14 toward the first plate 12, thereby applying the requisite compressive force to a panel 116. Such mechanisms may include, but are not limited to, a C-clamp having a plier action with an over center toggle mechanism, i.e., plier-type scissor action, or tong clamping force, hammer impact force or insertion of a chisel into the base shoe.

Figure 4:
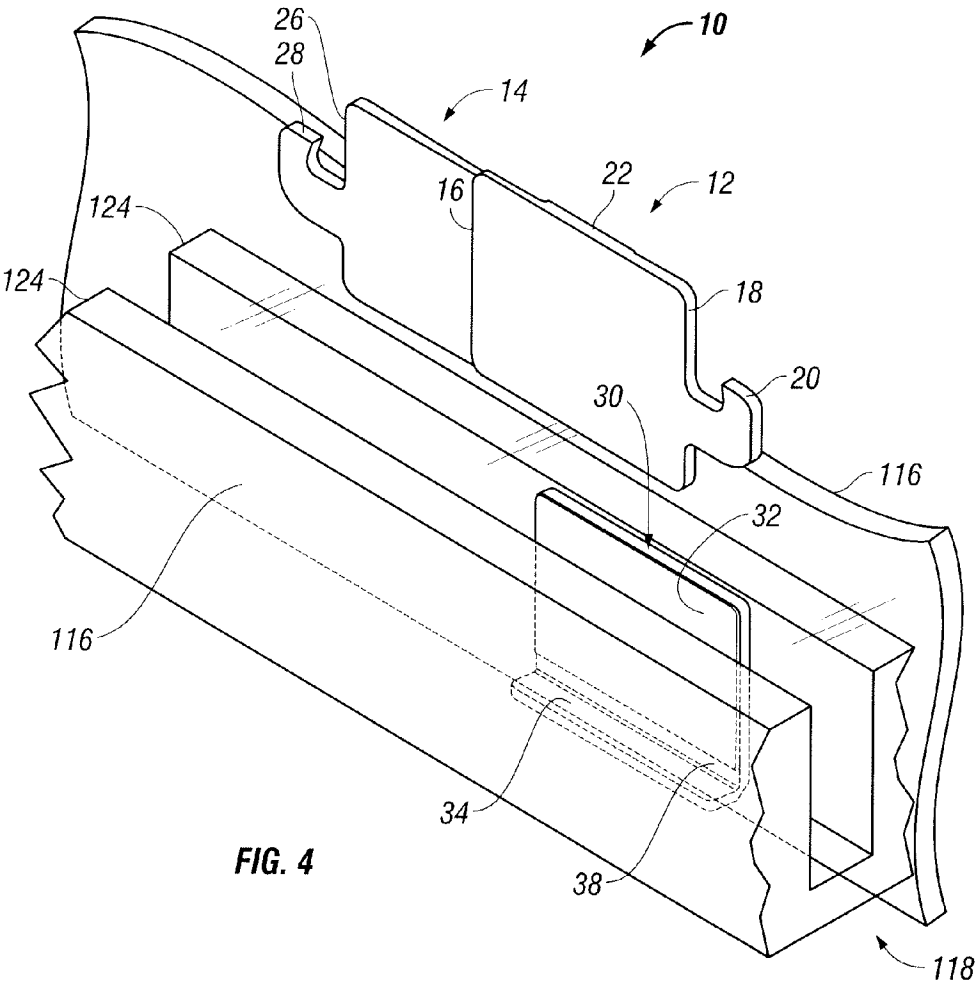
FIG. 4 is a perspective view of an embodiment of the installation system in accordance with the present invention shown with a panel and a base shoe.
Figure 5:
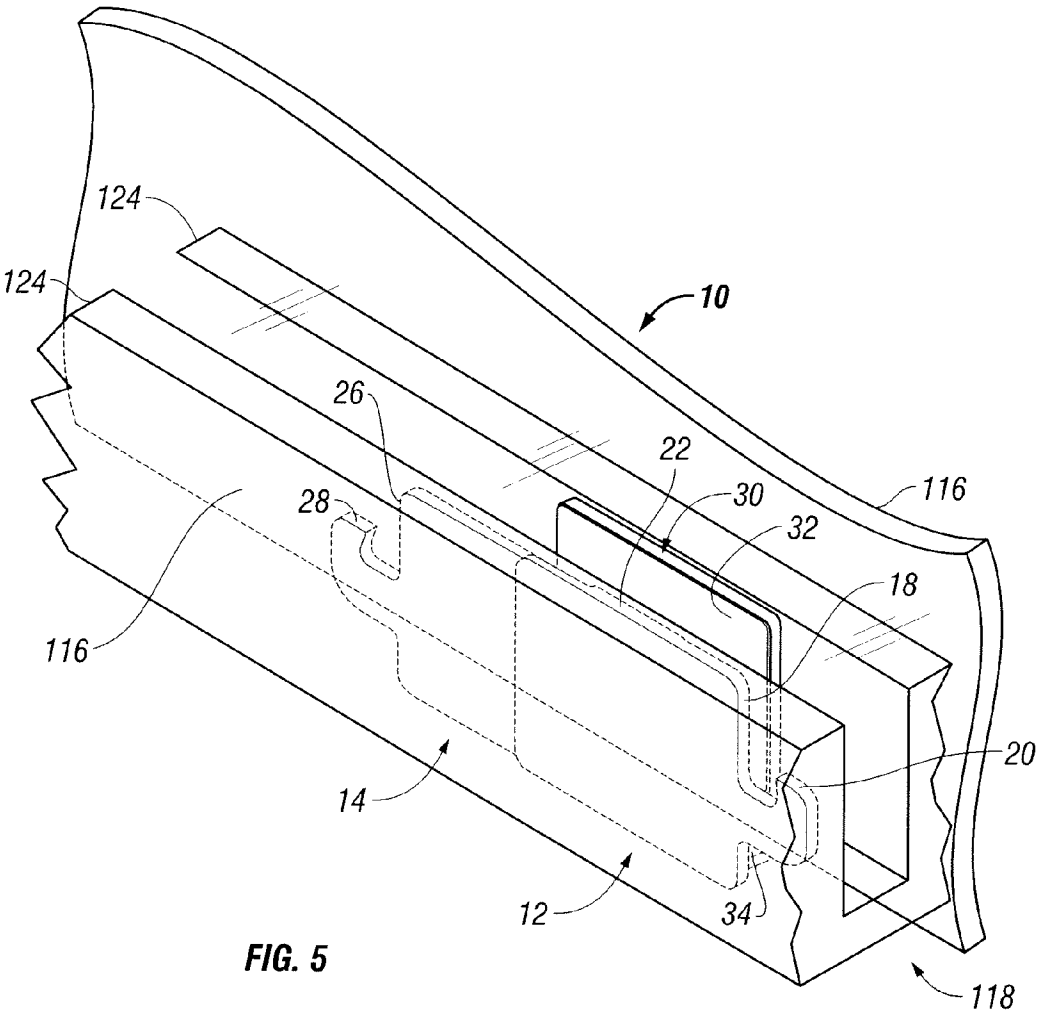
FIG. 5 is a perspective view of an embodiment of the installation system in accordance with the present invention shown with a panel and a base shoe.
Figure 6:
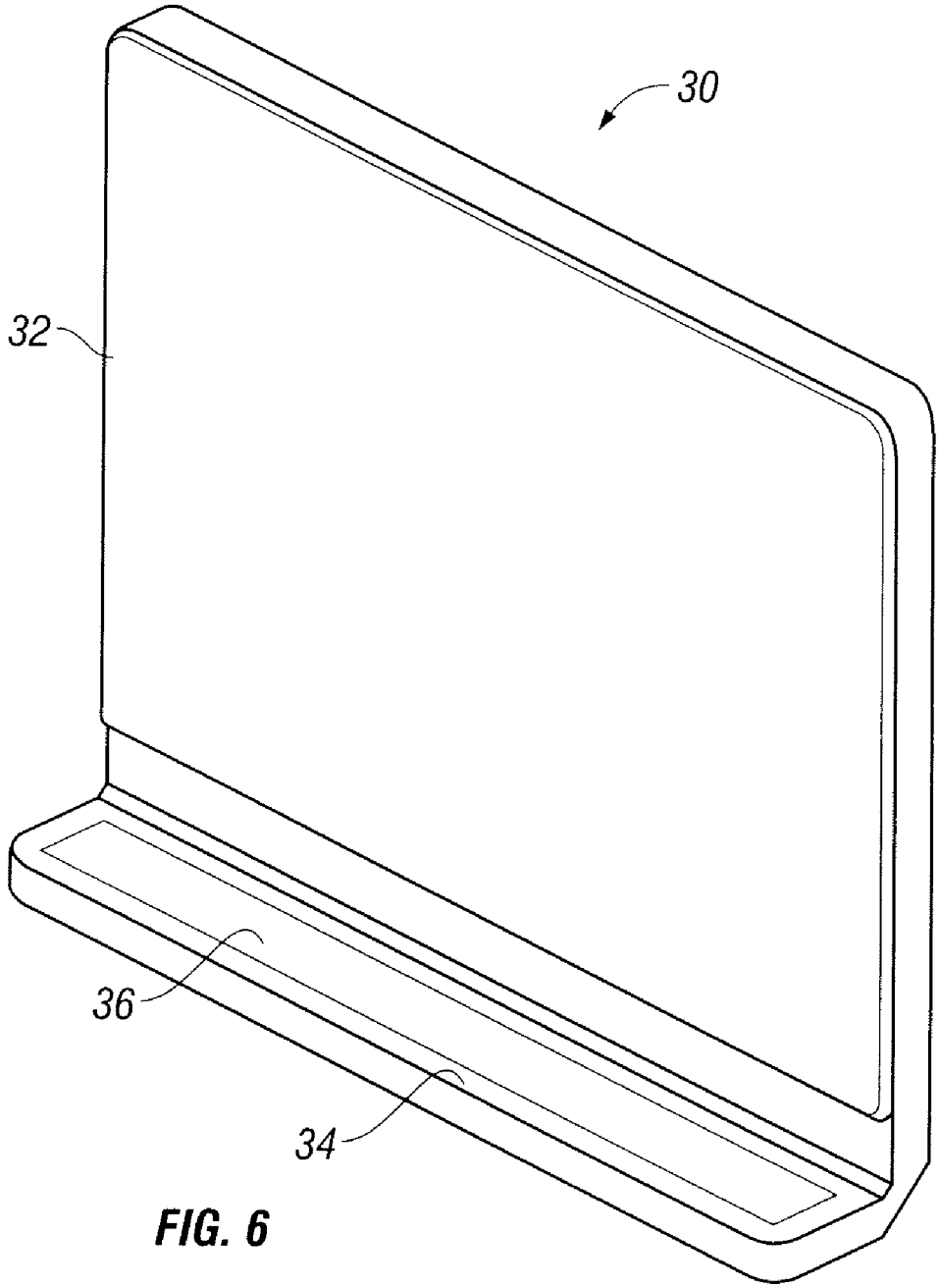
FIG. 6 is a perspective view of an embodiment of a spacer in accordance with the present invention.
Figure 7:
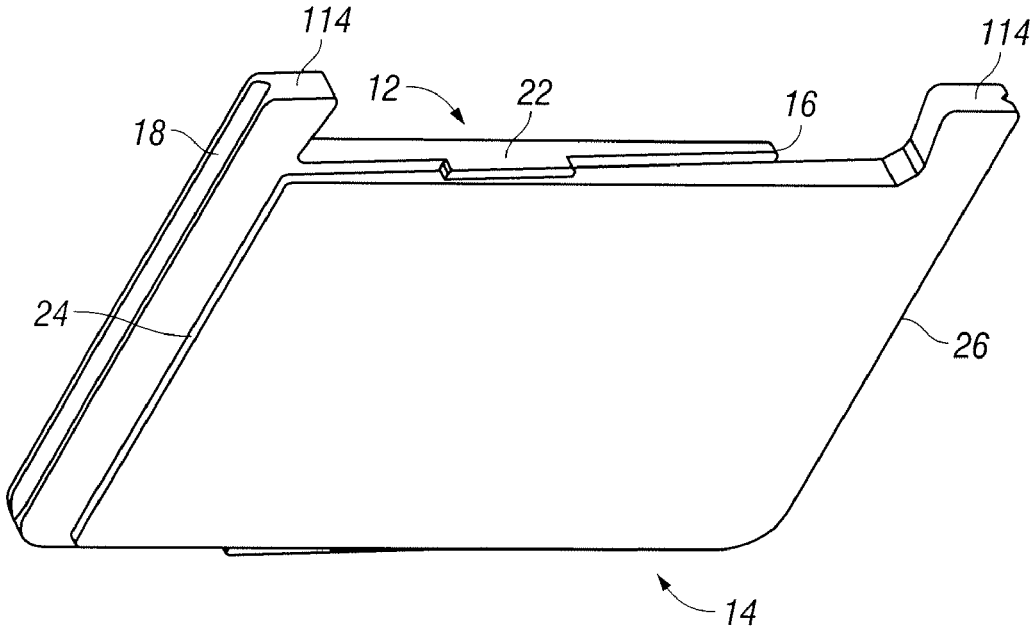
FIG. 7 is a perspective view of an embodiment of a first and second plate in accordance with the present invention.
Figure 8:
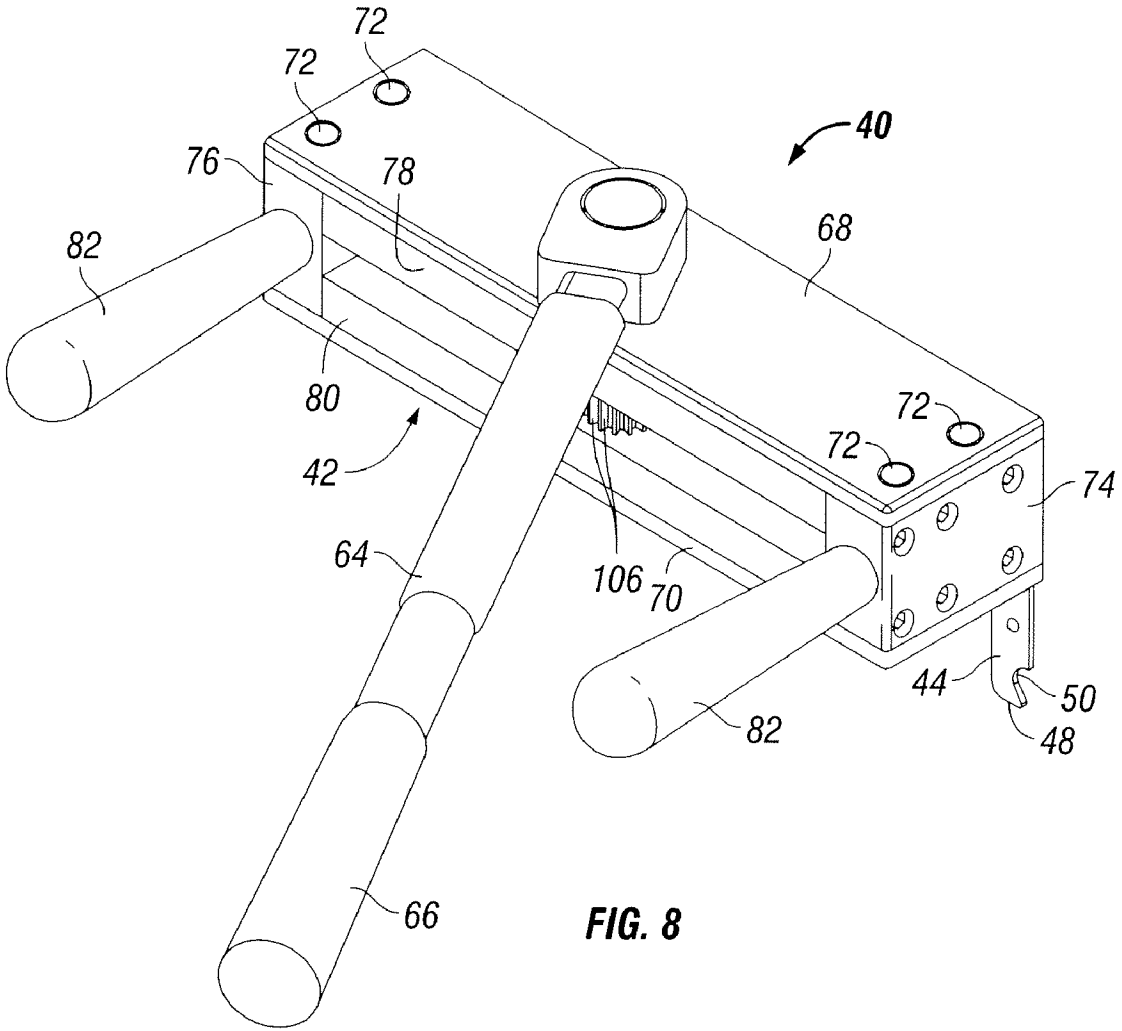
FIG. 8 is a perspective view of an embodiment of a installation tool in accordance with the present invention.
Figure 9:
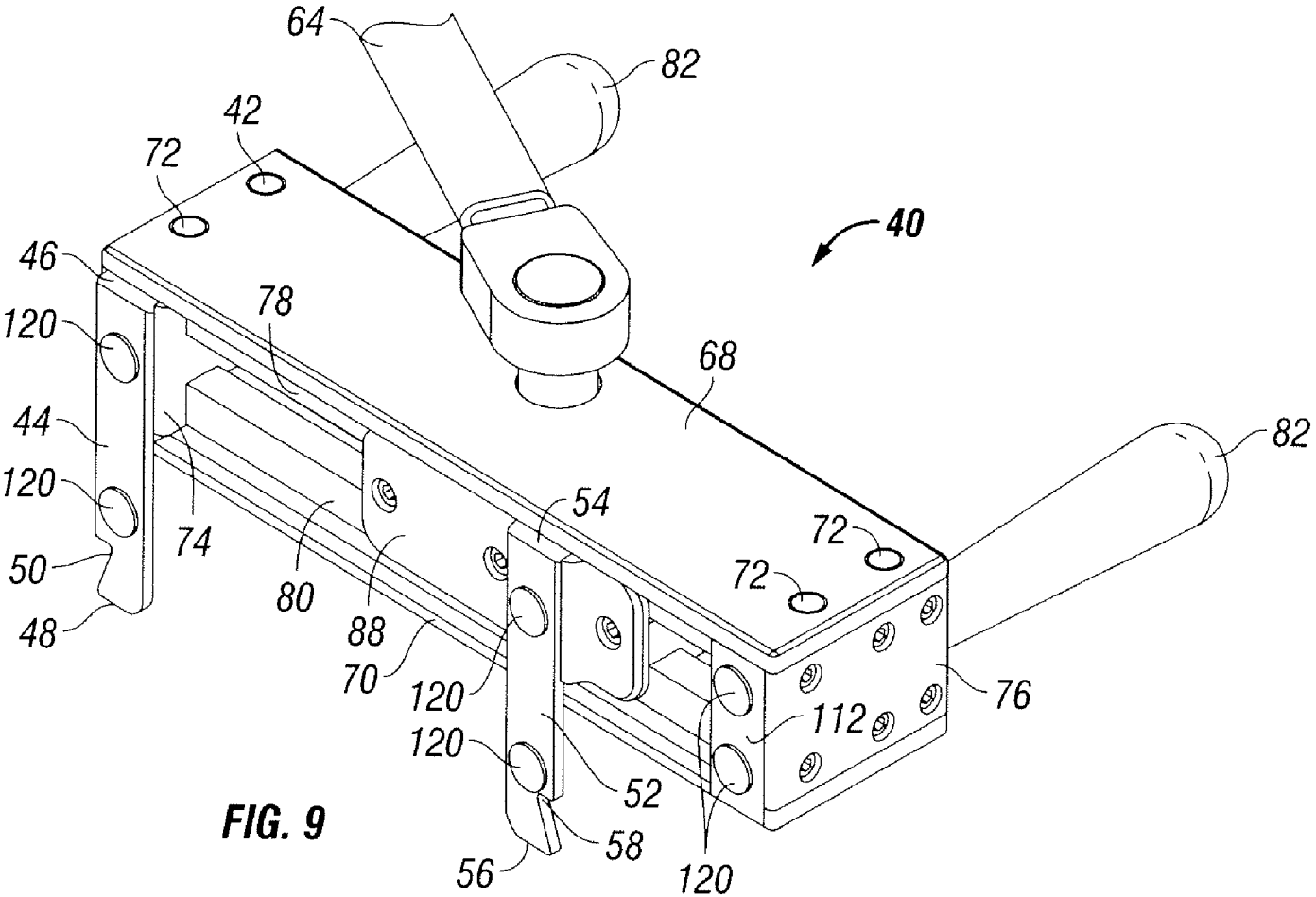
FIG. 9 is a perspective view of an embodiment of a installation tool in accordance with the present invention.
Figure 10:
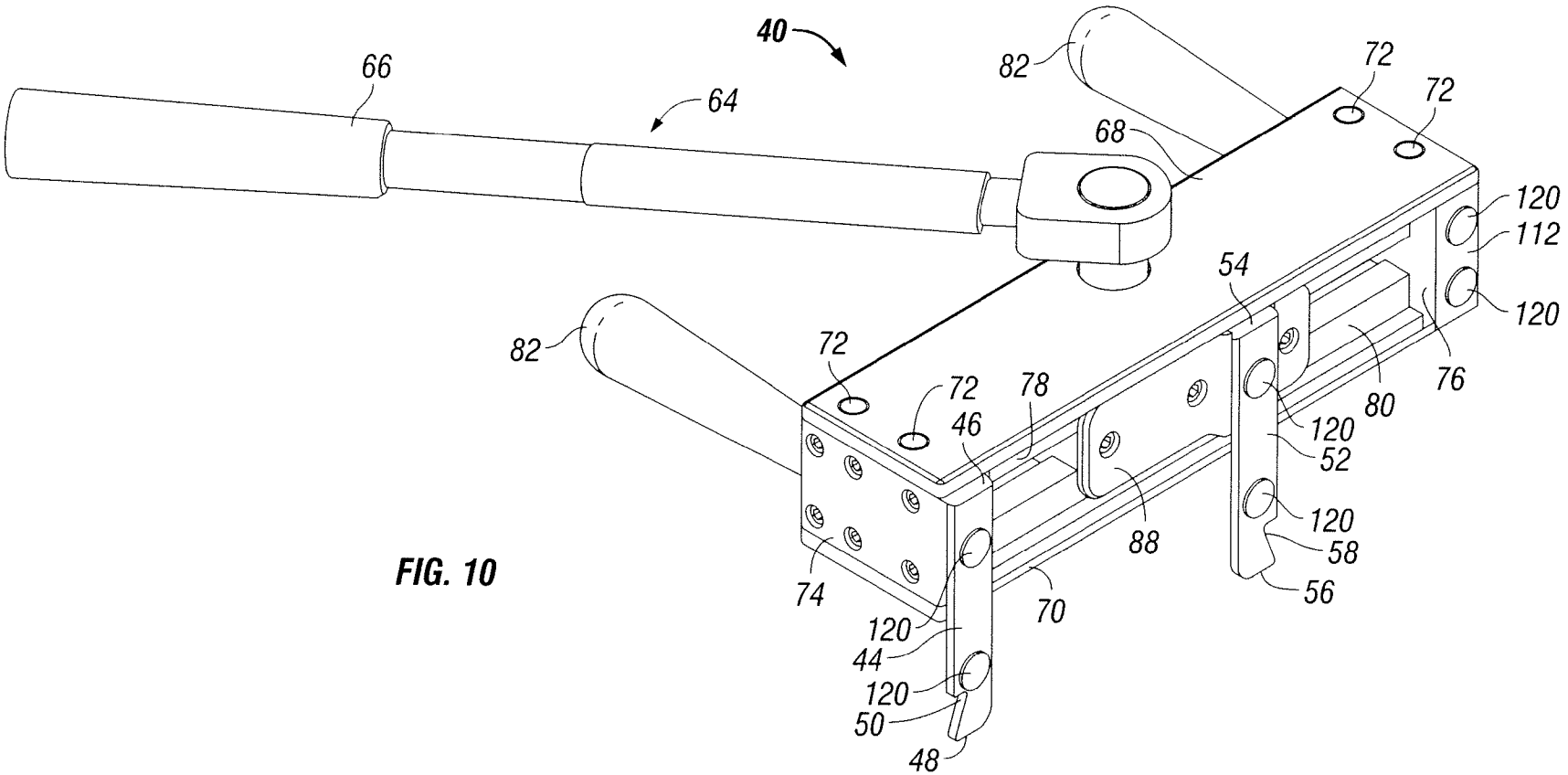
FIG. 10 is a perspective view of an embodiment of a installation tool in accordance with the present invention.
Figure 11:
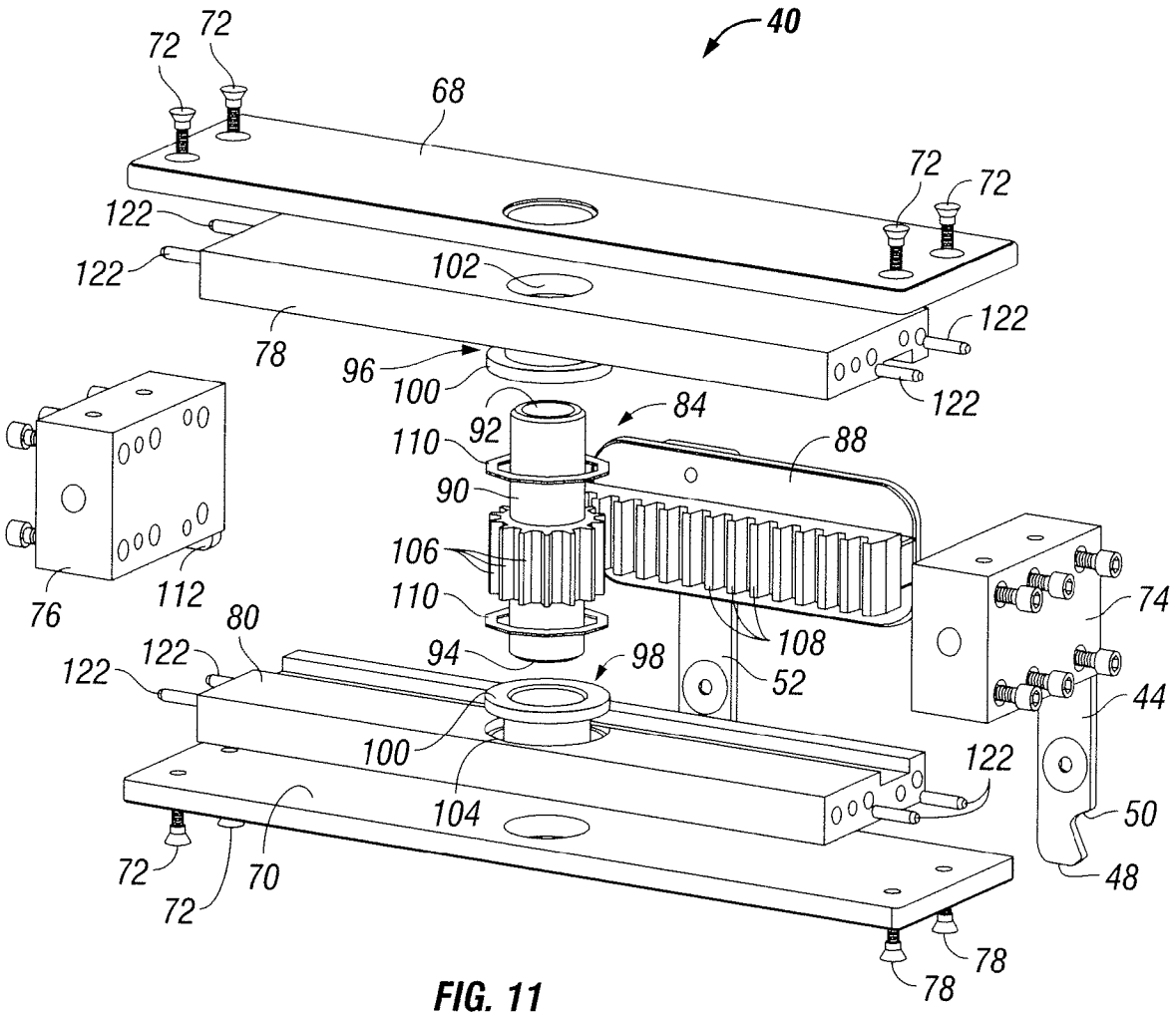
FIG. 11 is an exploded view of an embodiment of a installation tool in accordance with the present invention.
Figure 12:
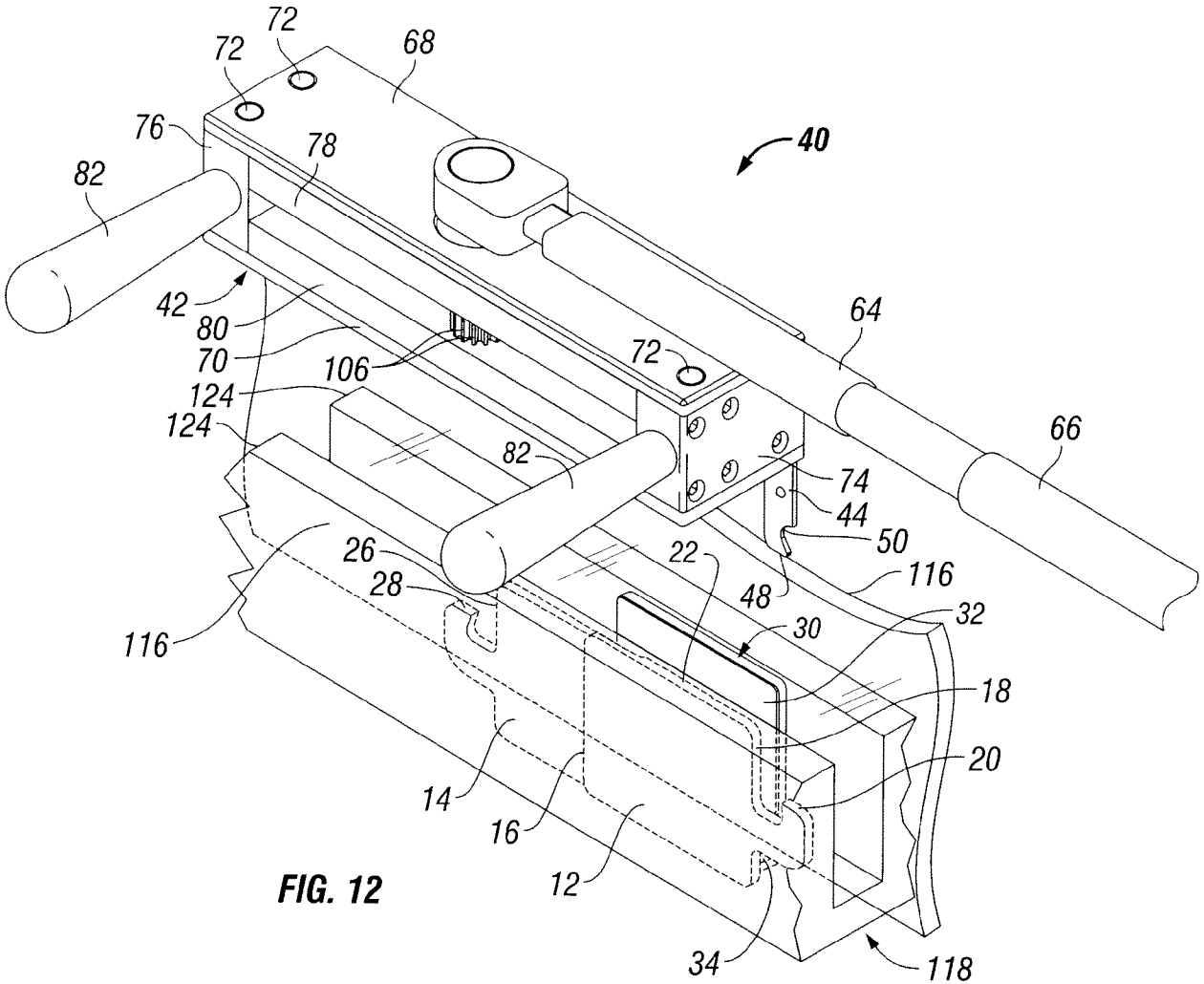
FIG. 12 is a perspective view of an embodiment of the installation system in accordance with the present invention shown with a panel and a base shoe.
Figure 13:
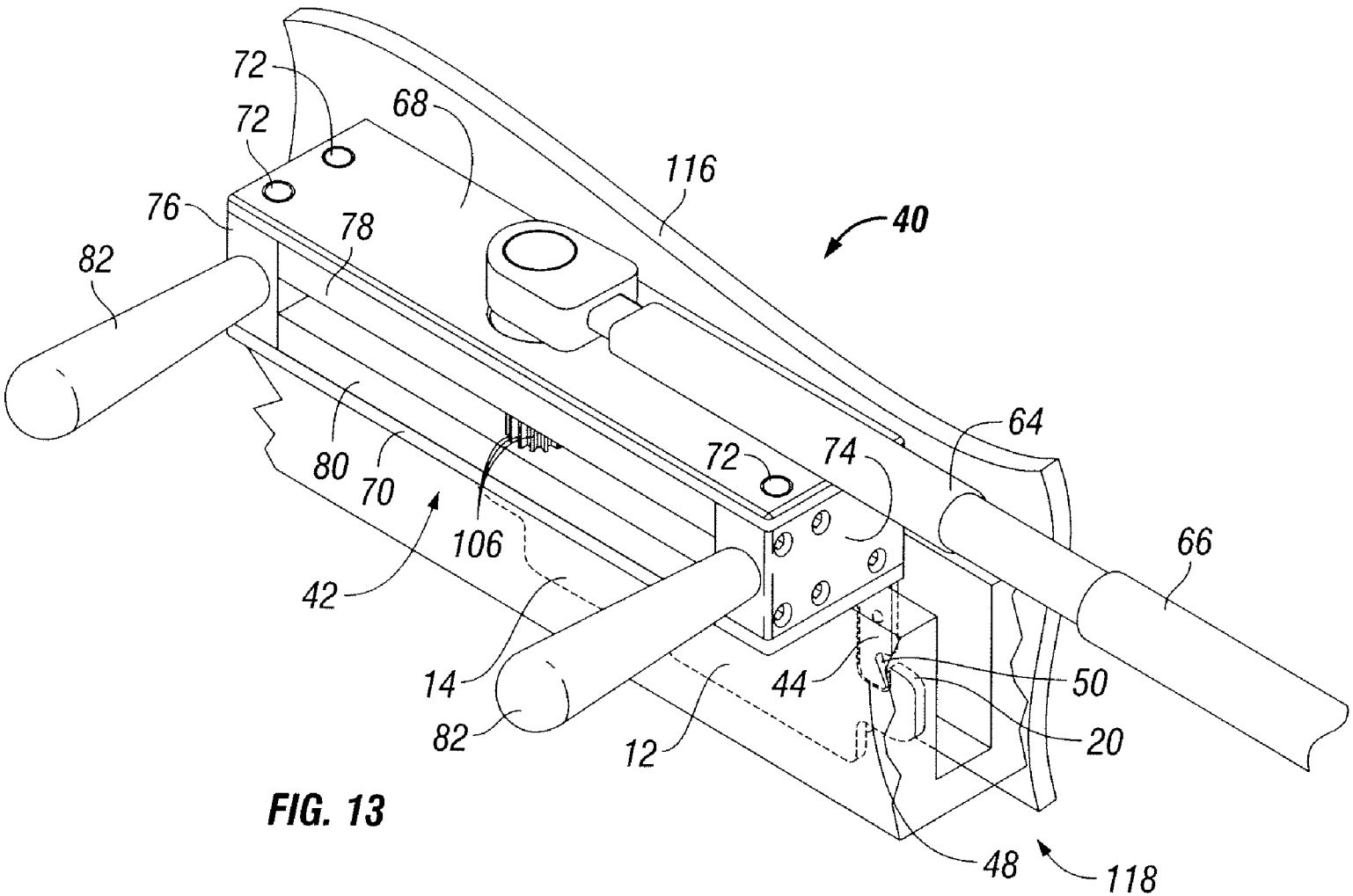
FIG. 13 is a perspective view of an embodiment of the installation system in accordance with the present invention shown with a panel and a base shoe.
Figure 14:
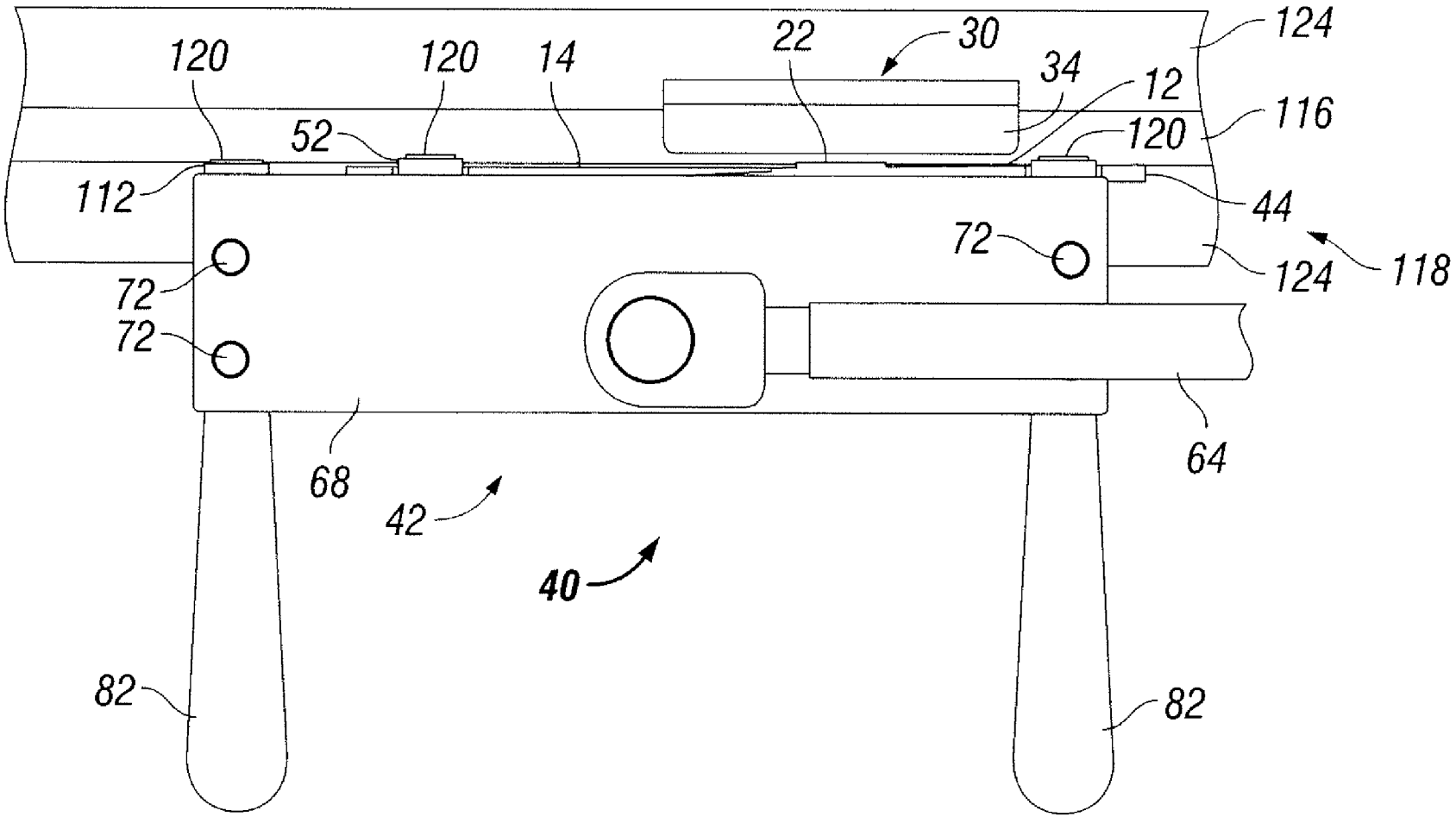
FIG. 14 is a top view of an embodiment of the installation system in accordance with the present invention shown with a panel and a base shoe.
Figure 15:
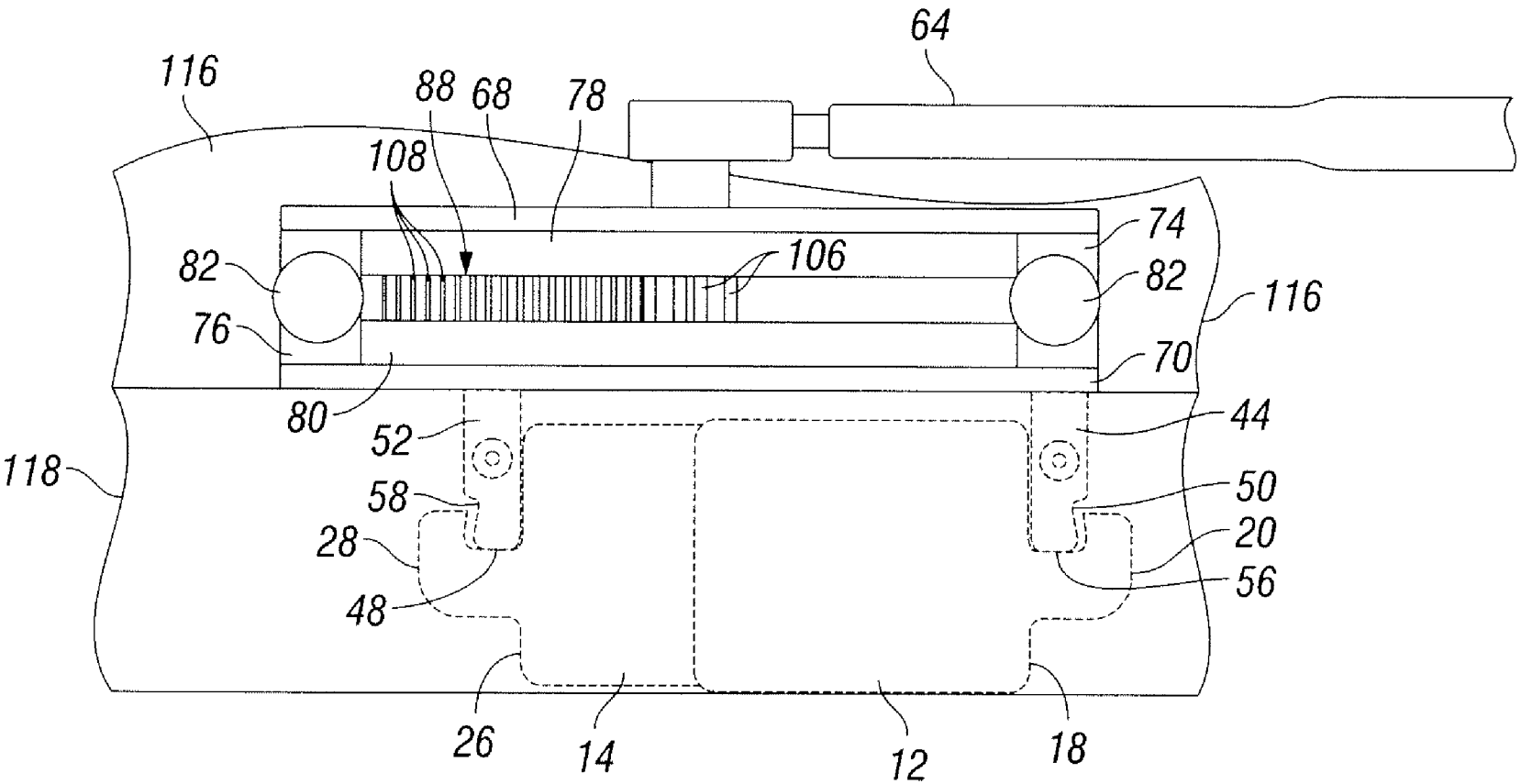
FIG. 15 is a plan view of an embodiment of the installation system in accordance with the present invention shown with a panel and a base shoe.
Figure 16:
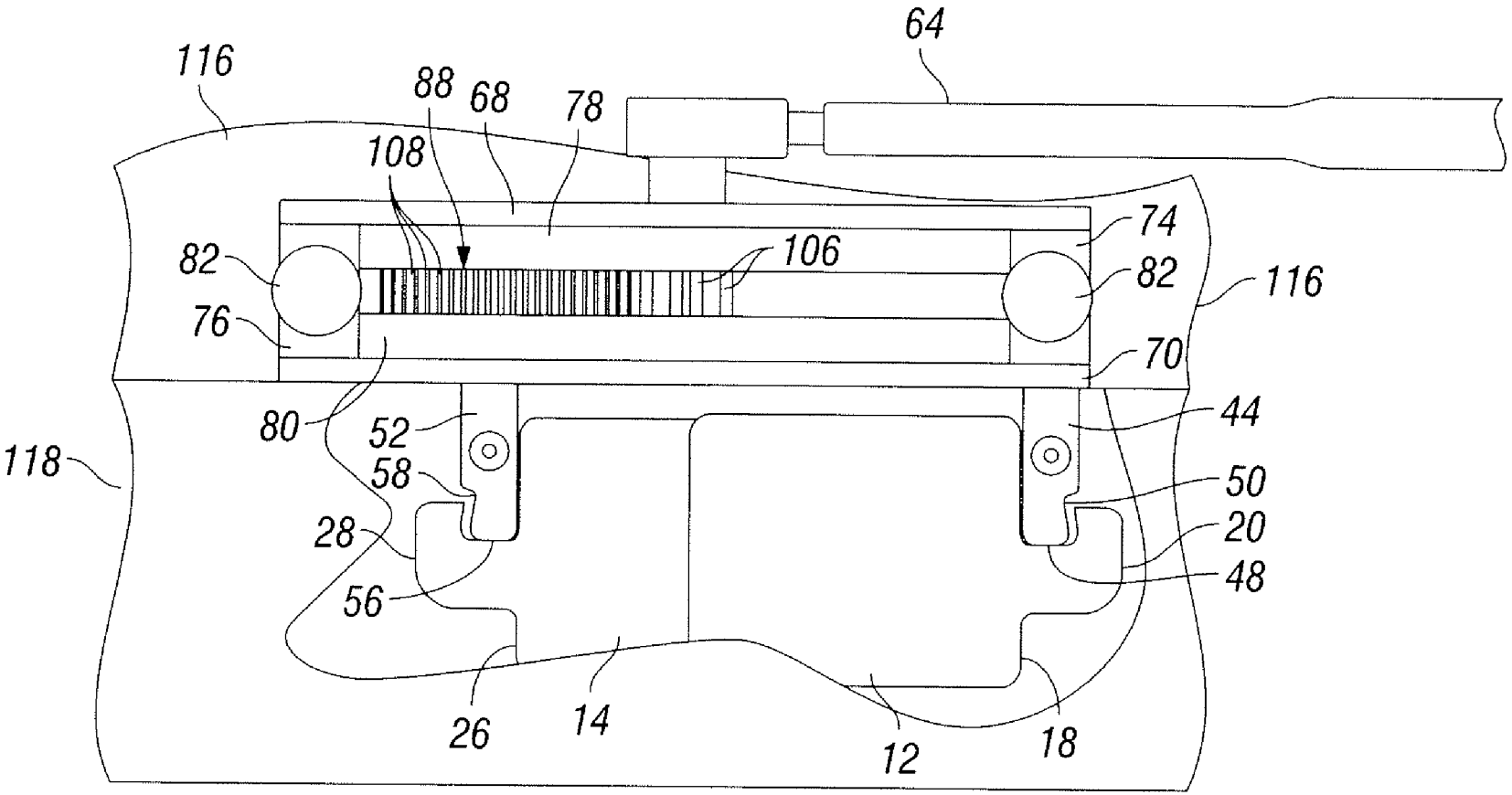
FIG. 16 is a plan view of an embodiment of the installation system in accordance with the present invention shown with a panel and a base shoe.
Figure 17:
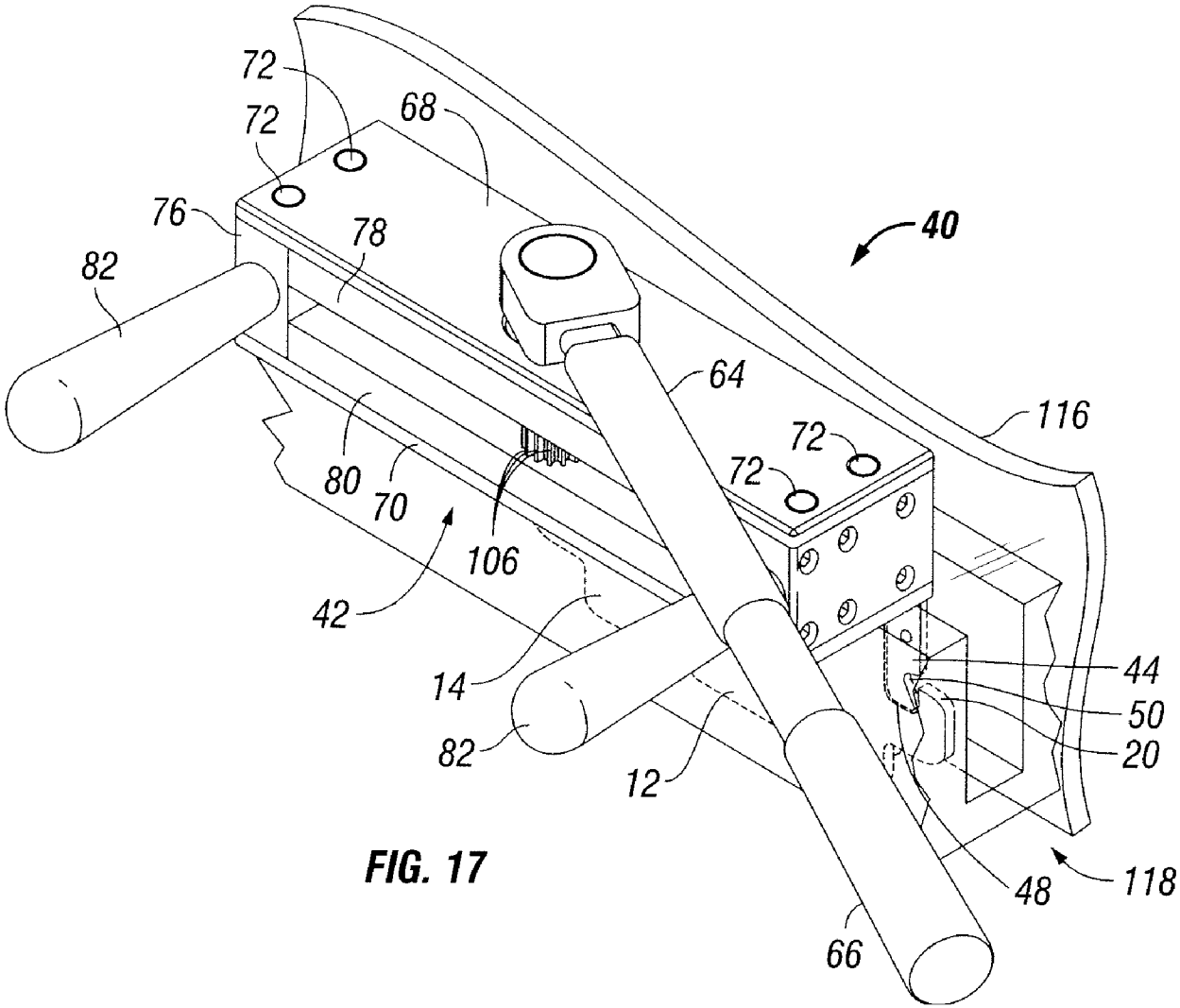
FIG. 17 is a perspective view of an embodiment of the installation system in accordance with the present invention shown with a panel and a base shoe.
Figure 18:
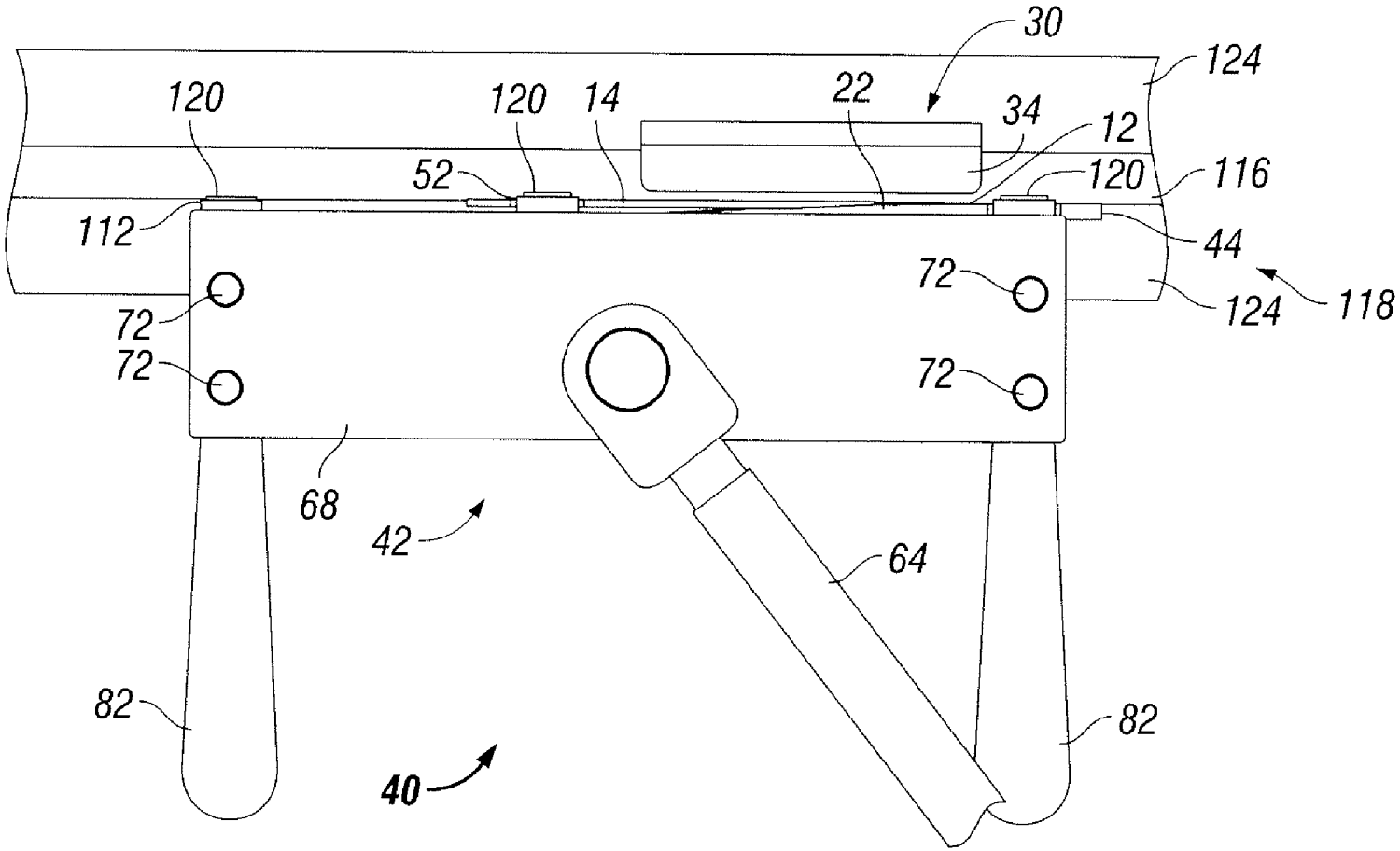
FIG. 18 is a top view of an embodiment of the installation system in accordance with the present invention shown with a panel and a base shoe.
Figure 19:
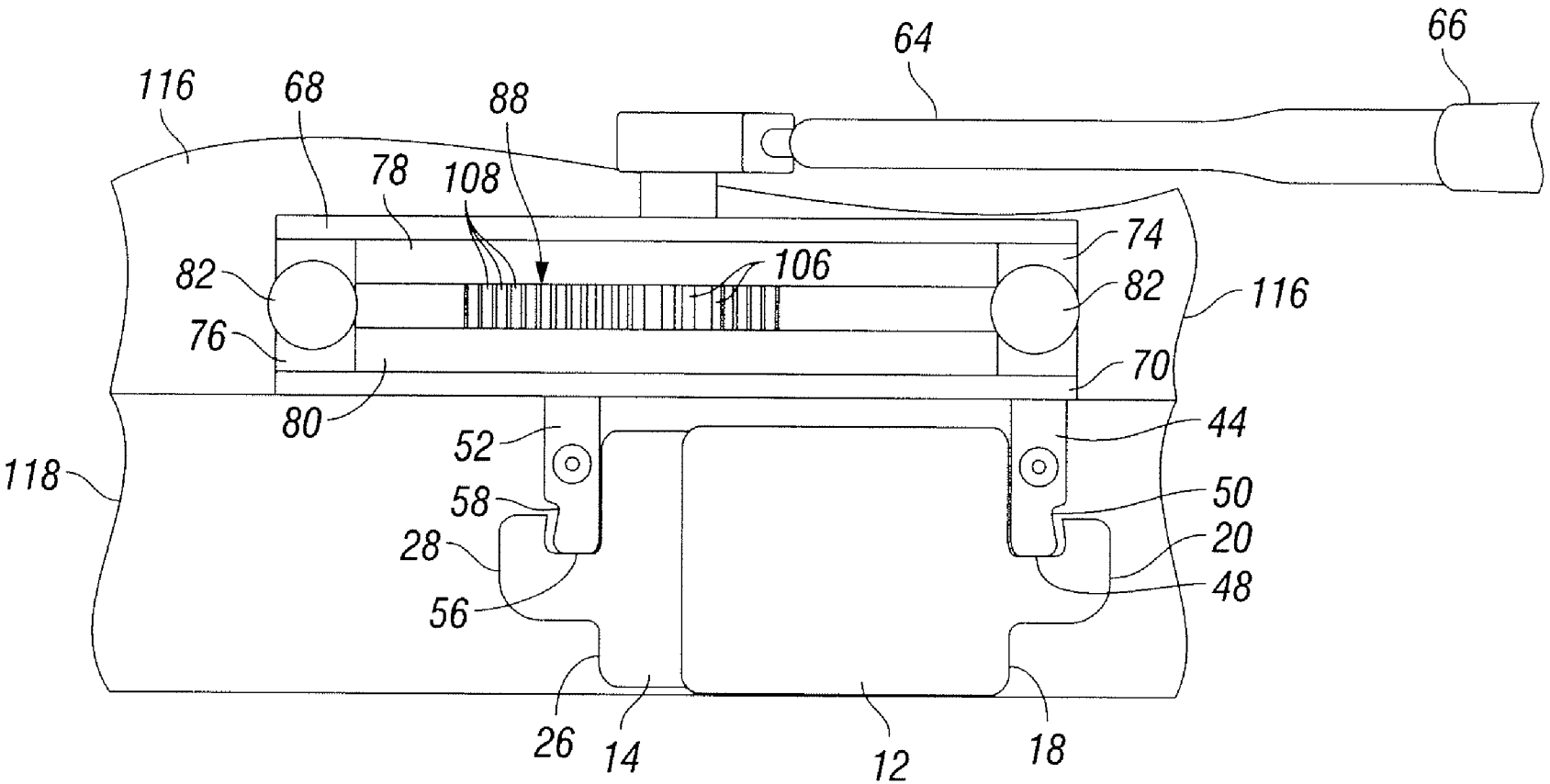
FIG. 19 is a plan view of an embodiment of the installation system in accordance with the present invention shown with a panel and a base shoe.
Figure 20:
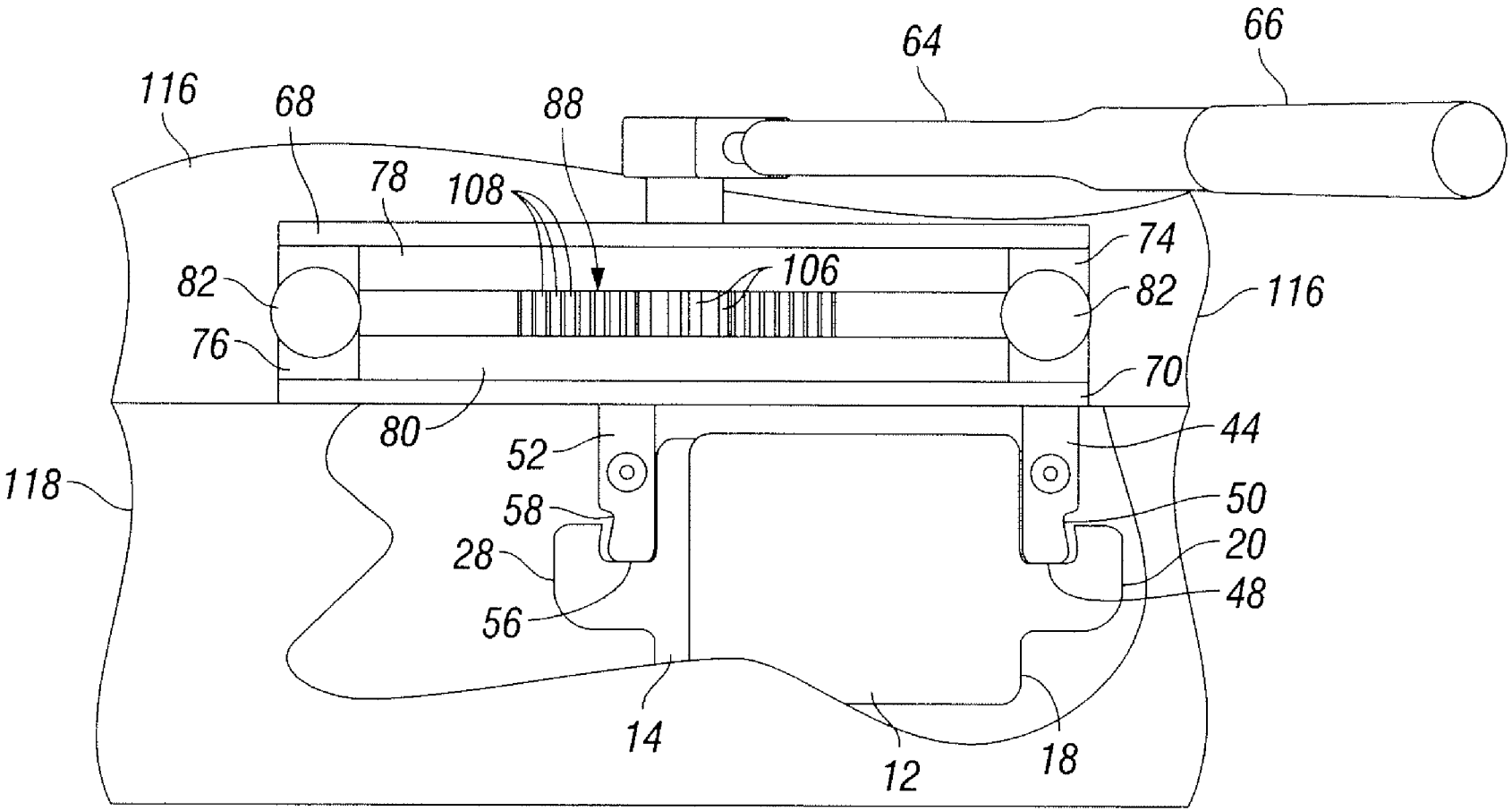
FIG. 20 is a plan view of an embodiment of the installation system in accordance with the present invention shown with a panel and a base shoe.
Figure 21:
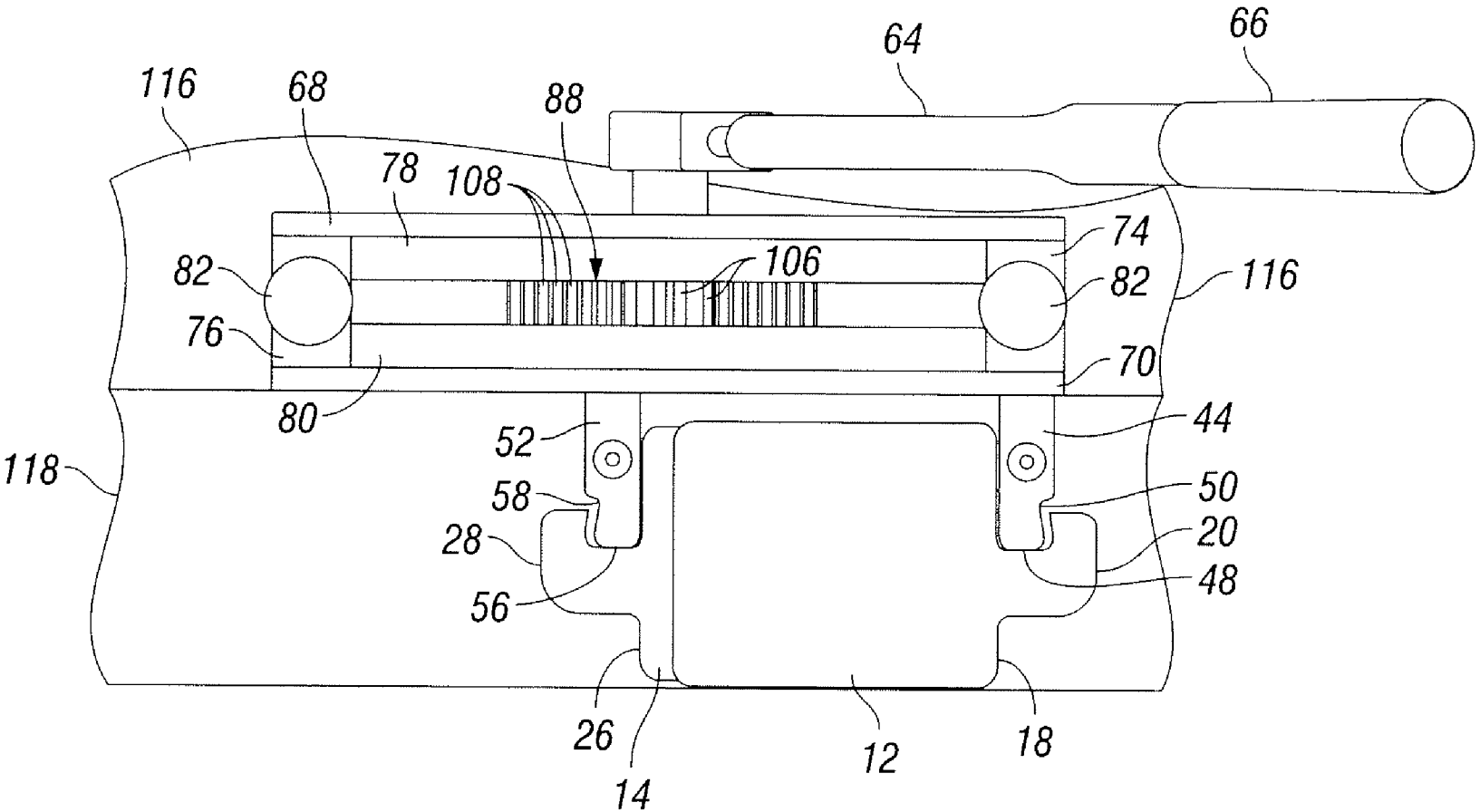
FIG. 21 is a plan view of an embodiment of the installation system in accordance with the present invention shown with a panel and a base shoe.

The steps of using the panel installation system will now be described with reference to FIGS. 1-5. First, an installer inserts one or more spacers 30 into a base shoe 118 having side walls 124. The panel to be installed is lowered into base shoe 118 so the bottom edge of the panel 116 rests on short leg 34 of spacer 30, as can best be seen in FIGS. 2-4. Preferably, panel 116 is secured to short leg 34 by sticking the bottom edge of the panel 116 to a strip of double-sided tape 36 on the short leg. First plate 12 and second plate 14 are attached using gib projection 22 on the top of first plate 12, which engages second plate 14. Thus, plates 12 and 14 are in an engaged and overlapping position with respect to each other, as shown in FIG. 4. The two plates then are inserted into the base shoe 118 on the man side of the panel 116 such that first plate 12 contacts the inner surface of base shoe 118 and second plate 14 contacts the man side of the panel 116. Alternatively, the tapered locking plates may be inserted sequentially, with first plate 12 inserted into the base shoe 118 first and second plate 14 inserted next. The installer then uses the selected mechanism to slide second plate 14 toward first plate 12, thereby narrowing the space within the base shoe 118 and applying the requisite compressive force to hold panel 116 in place. Upon completion of the panel securing process and application of the base shoe's decorative cladding, it is desirable to inject a bead of silicone along both sides of panel 116 in the groove resulting from the panel and base shoe's inner surfaces and above plates 12 and 14. The silicone serves as both an aesthetic finish and a moisture barrier. For extraction of the panel, e.g., for any adjustments, the installer uses the selected mechanism to slide second plate 14 away from first plate 12 to widen the space in the base shoe 118 and release the panel 116. In some embodiments, both first plate 12 and second plate 14 may be movable in relation to each other.

The panel installation system preferably includes installation tool 40, shown in detail in FIGS. 8-11, which is operated by the installer to insert and extract panels from a panel rail system. The installation tool 40 comprises a chassis 42, at least one fixed blade 44 having a first end 46 and a second end 48 and at least one movable blade 52 having a first end 54 and a second end 56. The installation tool chassis 42 comprises a top surface 68 and a bottom surface 70 to protect the clad finish on the base shoe 118 from potential damage through contact of the panel 116 to the inner metal components of the tool during installation. These surfaces also prevent scratching of the finished metals during extraction of a panel, for example, when the panel needs to be realigned. Top surface 68 and bottom surface 70 are preferably composed of a phenolic resin. The top and bottom surfaces also may be coated with a protective coating and/or may include an aesthetically pleasing layer of color finish. Cap screws 72 fixedly secure top surface 68 and bottom surface 70 to first and second block members 74, 76, which provide the short end structure of chassis 42. Top linear bearing 78 is adjacent non-metallic top surface 68, and bottom linear bearing 80 is adjacent non-metallic bottom surface 70. The linear bearings preferably are made of aluminum because it is a relatively light metal and machines faster than many other metals. Dowel pins 122 align linear bearings 78 and 80 in position with end block members 74 and 76. Installation tool 40 further may comprise at least one handle 82. A preferred embodiment has two handles, one at or near each end of the chassis 42 to accommodate both right-handed and left-handed users.

There are a plurality of engagement blades movably mounted to chassis 42, the blades being vertically extendable from the chassis between a base shoe 118 and a glass panel 116. The engagement blades preferably are attached to chassis 42 by flat head screws. At least one blade is fixed to chassis 42 and is not movable in relation to it. This fixed blade 44 has a first end 46 and a second end 48, the first end being attached to chassis 42 at first end block member 74. The second end 48 of fixed blade 44 has a groove 50, which is preferably generally V-shaped but may have different configurations as long as the second end 48 can mate with the projection tab 20 of first plate 12. Fixed blade 44 holds the installation tool 40 in its proper location within the base shoe 118 during the installation process. It also holds first plate 12 in place against the side wall 24 of base shoe 118. Movable blade 52 has a first end 54 and a second end 56. First end 54 of movable blade 52 is attached to rack 88 of the rack and pinion assembly described below, at an intermediate point along the length of the chassis 42. In a preferred embodiment, the second end 56 of movable blade 52 also has a generally V-shaped groove 58 for purposes of mating with the projection tabs of the plates. The engagement blades may have one or bumpers 120 on their surface to protect the panel 116 from scratches and may also include knurling on one or more blade surfaces. A third shorter end blade 112 is attached to chassis 42 at second end block member 76. As will be described in more detail herein, movable blade 52 moves second plate 14 toward first plate 12 to narrow the gap in the base shoe 118 and thereby tighten a flat panel 116 and clamp it in place.

Installation tool 40 includes a blade motion assembly 84 (alternatively called a ratcheting assembly or ratcheting mechanism) adapted to laterally moving one or both of the engagement blades relatively closer to one another in a locking operation and relatively apart from one another in an unlocking operation. In other words, the blade motion assembly 84 provides the mechanism by which the user moves the second plate 14 toward the first plate 12 and applies compressive force to the panel 116 to be installed. Blade motion assembly 84 comprises a rack 88 and a pinion shaft 90 having a top surface 92 and a bottom surface 94. Rack 88 is attached to top linear bearing 78 and is preferably made of steel. One or more wave springs 110 may be provided on the pinion shaft 90. An array of gear teeth 106 wraps around pinion shaft 90 and rotatably mates with a row of gear teeth 108 on rack 88. A torque wrench 64 also is provided as part of the blade motion assembly 84 of installation tool 40. The torque wrench 64 may have a grip 66 for ease of handling and manipulation by the installer. Torque wrench 86 passes through a hole in the top surface 68 and top linear bearing 78 to directly interface with top surface 92 of the pinion shaft 90. The interfacing is facilitated by an adapter at the internal end of the torque wrench 86, which may be a ⅜ inch square female by ½ inch male adapter, which mates with a recess at the top surface of pinion shaft 90. As will be described in more detail herein, when the torque wrench 86 is pulled in one direction by the user, it rotates the pinion shaft 90 so that the shaft gear teeth 106 engage rack gear teeth 108, thereby sliding the rack and moving the movable blade 52. Other systems could be used for the ratcheting mechanism, however, including but not limited to hydraulics or pneumatics.

Blade motion assembly 84 further comprises a first shoulder bushing 96 and a second shoulder bushing 98. The shoulder bushings are short cylinders which preferably have a circular flange 100 on one end. The shoulder bushing structure facilitates its disposal within a hole in a linear bearing. Thus, first shoulder bushing 96 is disposed within hole 102 of top linear bearing 78 and second shoulder bushing 98 is disposed within hole 104 of bottom linear bearing 80. Top surface 92 of pinion shaft 90 fits within the cylinder of the first shoulder bushing 96, and the pinion shaft bottom surface 94 fits within the cylinder of the second shoulder bushing 98. The shoulder bushings provide an annular bearing surface to handle thrust loads on the top face of the installation tool as the pinion shaft 90 is rotated. The shoulder bushings preferably are composed of bronze, but may be made of other materials known in the art that can effectively handle such thrust loads.

Referring to FIGS. 12-21, the operation of the installation tool 40 will now be described in connection with installation and removal of a panel using an embodiment of the installation system. In general, rotating the torque wrench causes the pinion shaft to rotate, and the pinion shaft rotation moves the rack, thereby moving the movable blade and sliding the second plate toward the first plate. The user first inserts one or more spacers 30 into a base shoe 118 having side walls 124. The panel 116 to be installed is lowered into the base shoe 118 so the bottom edge of panel 116 rests on short leg 34 of spacer 30. Preferably, the panel 116 is secured to short leg 34 by sticking the bottom edge of the panel to a strip of double-sided tape 36 on the short leg. First plate 12 and second plate 14 are attached using gib projection 22 on the top of first plate 12, which engages second plate 14. Thus, plates 12 and 14 are in an engaged and overlapping position with respect to each other. The two plates then are inserted into the base shoe 118 on the man side of panel 116 such that first plate 12 contacts the inner surface of the base shoe 118 and second plate 14 contacts the man side of the panel.

Installation tool 40 is then lowered onto the man side leg of base shoe 118 such that chassis 42 rests on the base shoe and rack 88 is within the pocket of the base shoe. The user aligns the second end 48 of fixed blade 44 with the projection tab 20 of first plate 12 so that second end 48 mates with tab 20. This mating of the fixed blade 44 keeps the tool stationary and in its proper location within the base shoe 118 during the installation process. Similarly, the second end 56 of movable blade 52 is aligned with the projection tab 28 of the second plate 14 so the second end 56 mates with tab 28. By pushing down on installation tool 40, the downward forces of the fixed blade 44 on projection tab 20 of the first plate 12 and the movable blade 52 on projection tab 28 of the second plate 14 pushes the first and second plate down to the bottom of the base shoe 118. If the installer is using the embodiment of plates in which the projection tabs are on the top of the plates substitution of shorter blades may be required.

Next, the user clasps torque wrench grip 66 and rotates torque wrench 64 in a clockwise direction. This clockwise rotation causes the ratcheting assembly to rotate pinion shaft 90. The ratcheting mechanism permits torquing, i.e., rotation, of torque wrench 64 in only one direction at a time. The wave springs 110 provide a clutch-type frictional load to hold the position of rack 88 for proper functioning of the rack and pinion ratcheting mechanism. In the absence of wave springs 110, free rotation of the pinion shaft 90 would not provide sufficient resistance to prevent the torque wrench ratcheting mechanism from causing rack 88 to move freely during clockwise and counterclockwise wrench rotational action. When the wave springs 110 are compressed close to a flat configuration, they apply pressure to the pinion so there is sufficient rotational resistance to prevent any undesired movement of the rack 88 from pinion shaft 90.

The engagement of the adapter of the clockwise-rotating torque wrench 64 with the top surface 92 of pinion shaft 90 transfers the rotation to the pinion shaft. As pinion shaft 90 begins to rotate in a clockwise direction, the pinion gear teeth 106 interlock with rack gear teeth 108 and cause rack 88, and the movable blade 52 attached thereto, to move in the direction of the fixed blade 44. The clockwise torque also affects the fixed blade 44 and pulls the fixed blade so it turns and pulls against the base shoe 118. It should be noted that the knurling on the surface of fixed blade 44 safeguards against this pulling action and helps hold the blade in place. The bottom of the base shoe bears most of the torque wrench rotation load.

As movable blade 52 is moved in the direction of fixed blade 44 by the rack and pinion mechanism, second end 56 of movable blade 52 forces the second plate 14 to slide toward first plate 12. The complementary tapered surfaces of second plate 14 and first plate 12 overlap, thereby narrowing the space within base shoe 118 and applying the requisite compressive force to hold panel 116 in place. The shaft of the torque wrench 64 may have an adjustable display whereby the user can program the proper torque setting, which may vary depending on certain conditions and components including which types of plates are used. The display may include numbers and bars and includes a micrometer scale dial to show the torquing force to be applied. The precision tool may comprise a torque range indicator that provides a sensory cue when the rotation of the torque wrench has provided the compressive force necessary to hold the panel in the base shoe. This cue may be a tactile cue, a vibrational cue, a visual cue and/or an audible cue. Specifically, the micrometer may provide an audible click when the proper torque is achieved. The blade motion assembly also may provide a break in motion or may vibrate to indicate that installation is complete. Then the user lifts installation tool 40 out of the base shoe 118 and moves on to the next spacer and plate assembly if necessary.

For extraction of the panel, e.g., for any adjustments or removal, the installation tool 40 is set on the person side leg of the base shoe 118 such that chassis 42 rests on the base shoe and rack 88 is within the pocket of the base shoe. The user aligns the second end 48 of fixed blade 44 with projection tab 20 of first plate 12 so that second end 48 mates with tab 20. The second end 56 of movable blade 52 is aligned with the projection tab 28 of the second plate 14 so the second end 56 mates with tab 28. The user then reverses the ratcheting mechanism, grasps the torque wrench grip 66 and rotates it counter-clockwise. As pinion shaft 90 begins to rotate in a counter-clockwise direction, the pinion gear teeth 106 interlock with rack gear teeth 108 and cause rack 88, and the movable blade 52 attached thereto, to move away from the fixed blade 44. As movable blade 52 is moved away from fixed blade 44 by the rack and pinion mechanism, second end 56 of movable blade 52 engages projection tab 28 of second plate 14, urging the second plate to slide away from first plate 12. The complementary tapered surfaces of second plate 14 and first plate 12 disengage, thereby widening the space within the base shoe 118, easing the compressive force and releasing panel 116. Shorter end blade 112 prevents installation tool 40 from rotating during removal by catching the edge of the base shoe to prevent the counter-clockwise torque from moving the tool. The user then lifts installation tool 40 out of the base shoe and moves on to the next spacer and plate system if necessary. It should be noted that embodiments of the glass locking system may comprise moving both plates relative to each other, i.e., uninstalling a glass panel by engaging the projection tabs with an installation tool and moving the plates laterally apart from one another.

Thus, it is seen that a panel installation system and a installation tool are provided. It should be understood that any of the foregoing configurations and specialized components may be interchangeably used with any of the systems of the preceding embodiments. Although preferred illustrative embodiments of the present invention are described hereinabove, it will be evident to one skilled in the art that various changes and modifications may be made therein without departing from the invention. It is intended in the appended claims to cover all such changes and modifications that fall within the true spirit and scope of the invention.

What is claimed is:

1. A glass locking system of locking a glass panel within a base shoe having side walls, comprising:

a first laterally tapered plate having a first end and a second end, the first plate being laterally tapered from the second end to the first end, the first end being thinner than the second end;

a second laterally tapered plate having a first end and a second end, the second plate being laterally tapered from the second end to the first end, the first end being thinner than the second end;

the first and second plates being positionable in overlapping relation with opposing taper directions between a first one of the side walls of the base shoe and the glass panel, the plates being laterally movable in relation to one another and impinging upon one another generating a compressive force on the glass panel between one side of one of said plates and a second one of the side walls of the base shoe.

2. The system of claim 1 further comprising a spacer located within the base shoe and supporting the glass panel, the spacer having a substantially L-shaped cross section.

3. The system of claim 1 wherein the first tapered plate further comprises a gib projection on its top surface.

4. The system of claim 3 wherein the gib projection of the first plate engages a top portion of the second plate.

5. The system of claim 1 wherein one or more of the first plate and the second plate further has a projection tab extending from its first or second end.

6. The system of claim 5 wherein the projection tab has a hook-shaped profile.

7. The system of claim 6 further comprising an installation tool having a chassis and at least two engagement blades mounted to the chassis, at least one of the engagement blades being movably mounted to the chassis, at least one of the engagement blades mating with the hook-shaped projection tab.

8. The system of claim 7 wherein moving one of the engagement blades slides at least one of the tapered plates in a lateral direction relative to the other tapered plate.

9. The system of claim 5 wherein the projection tab receives separating force when the first and second plates are separated.

10. The system of claim 5 further comprising an installation tool having a chassis and at least two engagement blades mounted to the chassis, at least one of the engagement blades being movably mounted to the chassis, at least one of the engagement blades engaging the projection tab.

11. The system of claim 10 wherein moving one of the engagement blades slides at least one of the tapered plates in a lateral direction relative to the other tapered plate.

12. The system of claim 1 further comprising means for sliding the second and first tapered plates in a sideways direction in relation to one another.

13. The system of claim 1 further comprising an installation tool having a chassis and at least two engagement blades mounted to the chassis, at least one of the engagement blades being movably mounted to the chassis.

14. The system of claim 1 wherein a first side of the first plate is laterally tapered from the second end to the first end and a second side of the first plate is substantially flat.

15. The system of claim 1 wherein a first side of the second plate is laterally tapered from the second end to the first end and a second side of the second plate is substantially flat.

16. The system of claim 1 wherein one or more of the first plate and the second plate further has a projection tab extending from a top portion of the plate.

17. A method of installing a panel in a base shoe having side walls comprising:

inserting a spacer into the base shoe;

resting a panel on the spacer;

inserting a first tapered locking plate into the base shoe between one of the base shoe sidewalls and the panel, inserting a second tapered locking plate into the base shoe, between one of the base shoe sidewalls and the panel and at least partially overlapping with the first tapered locking plate, the first tapered locking plate being partially positioned between the second tapered locking plate and the panel;

moving one or both of the first tapered locking plate and the second tapered locking plate laterally in relation to one another to lock the panel in place.

18. The method of claim 17 wherein the first and second tapered locking plates each include a projection tab, further comprising uninstalling a glass panel by engaging the projection tabs with an installation tool and moving them laterally apart from one another.

19. The method of claim 17 wherein moving the first and second locking plates includes:

positioning engagement blades of a locking tool between the panel and a sidewall of the base shoe; and moving one or both of the engagement blades laterally with respect to each other.

* * * * *